US012631373B2

(12) United States Patent
Hirawa et al.

(10) Patent No.: US 12,631,373 B2
(45) Date of Patent: May 19, 2026

(54) ELECTRIC COMPONENT UNIT, AND HEAT SOURCE UNIT FOR REFRIGERATION CYCLE APPARATUS

(71) Applicant: DAIKIN INDUSTRIES, LTD., Osaka (JP)

(72) Inventors: Daiki Hirawa, Osaka (JP); Katsutoshi Sakurai, Osaka (JP); Makoto Takayanagi, Osaka (JP); Taichi Koshiji, Osaka (JP); Hiroaki Matsuda, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 103 days.

(21) Appl. No.: 18/620,033

(22) Filed: Mar. 28, 2024

(65) Prior Publication Data

US 2024/0240840 A1 Jul. 18, 2024

Related U.S. Application Data

(63) Continuation of application No. PCT/JP2022/036035, filed on Sep. 27, 2022.

(30) Foreign Application Priority Data

Sep. 30, 2021 (JP) ..... 2021-161995

(51) Int. Cl.
*F25B 31/00* (2006.01)

(52) U.S. Cl.
CPC ..... *F25B 31/00* (2013.01); *F25B 2313/008* (2013.01)

(58) Field of Classification Search
CPC ..... F24F 2013/207; F24F 1/22
See application file for complete search history.

(56) References Cited

U.S. PATENT DOCUMENTS 8,047,013 B2 11/2011 Ishikawa et al.
2009/0077988 A1 3/2009 Ishikawa et al.

FOREIGN PATENT DOCUMENTS

EP 3101354 A1 * 12/2016 ..... F24F 1/22
JP H03-168544 A 7/1991

(Continued)

OTHER PUBLICATIONS

International Preliminary Report on Patentability issued in International Application No. PCT/JP2022/036035, mailed Apr. 11, 2024 (6 pages).

(Continued)

*Primary Examiner* — Lionel Nouketcha
(74) *Attorney, Agent, or Firm* — Osha Bergman Watanabe & Burton LLP

(57) ABSTRACT

An electric component unit of a refrigeration cycle apparatus, includes: a first electric board; a second electric board; a mounting member having a first surface on which the first electric board is disposed, and a second surface on which the second electric board is disposed; and an electric component casing having a maintenance opening. The mounting member is coupled to the electric component casing via a coupling portion. The electric component unit switches between a first state and a second state by rotation of the mounting member about the coupling portion. In the first state, the second electric board is accessible through the maintenance opening, and the first electric board, the second electric board, and the mounting member are all housed in the electric component casing. In the second state, the first electric board is accessible through the maintenance opening.

7 Claims, 16 Drawing Sheets

(56) References Cited

FOREIGN PATENT DOCUMENTS

| | | | |
|---|---|---|---|
| JP | 2009-210158 | A | 9/2009 |
| JP | 2011-232010 | A | 11/2011 |
| JP | 5471783 | B2 | 4/2014 |
| JP | 2019-143880 | A | 8/2019 |
| JP | 2021-119322 | A | 8/2021 |
| WO | 2007/108447 | A1 | 9/2007 |

OTHER PUBLICATIONS

Extended European Search Report issued in European Application No. 22876274.6, dated Dec. 19, 2024 (8 pages).
International Search Report issued in International Application No. PCT/JP2022/036035 mailed Dec. 20, 2022 (2 pages).

* cited by examiner

ELECTRIC COMPONENT UNIT, AND HEAT SOURCE UNIT FOR REFRIGERATION CYCLE APPARATUS

CROSS-REFERENCE TO RELATED APPLICATIONS

This is a continuation application of International Patent Application No. PCT/JP2022/036035, filed Sep. 27, 2022, and claims priority to Japanese Patent Application No. 2021-161995, filed Sep. 30, 2021. The contents of these priority applications are incorporated herein by reference.

TECHNICAL FIELD

The present disclosure relates to an electric component unit, and a heat source unit for a refrigeration cycle apparatus.

BACKGROUND

Conventionally, outdoor units for refrigeration cycle apparatuses such as air conditioners have been used, including components such as a compressor and heat exchanger that constitute a refrigerant circuit, and an electric component unit for controlling the various components.

For example, in an air conditioner disclosed in Patent Literature 1 (JP 2021-119322 A), there has been proposed an outdoor unit having a structure in which an electric component box is disposed on the front side of a machine chamber, and a service panel to be removed from a housing at the time of maintenance is provided on the front side of the electric component box.

SUMMARY

An electric component unit according to one or more embodiments is an electric component unit for a refrigeration cycle apparatus, and includes a first electric board, a second electric board, a mounting member, and an electric component casing. The mounting member has a first surface and a second surface. The first electric board is attached to the first surface. The second electric board is attached to the second surface. The electric component casing has a maintenance opening. The mounting member and the electric component casing are coupled to each other via a coupling portion. The electric component unit switches between a first state and a second state. In the first state, the first electric board, the second electric board, and the mounting member are housed in the electric component casing. In the second state, a position of the first electric board, the second electric board, and the mounting member with respect to the maintenance opening is moved to a position different from the first state by rotation of the mounting member about the coupling portion.

DETAILED DESCRIPTION

(1) Configuration of Refrigeration Cycle Apparatus

Figure 1:
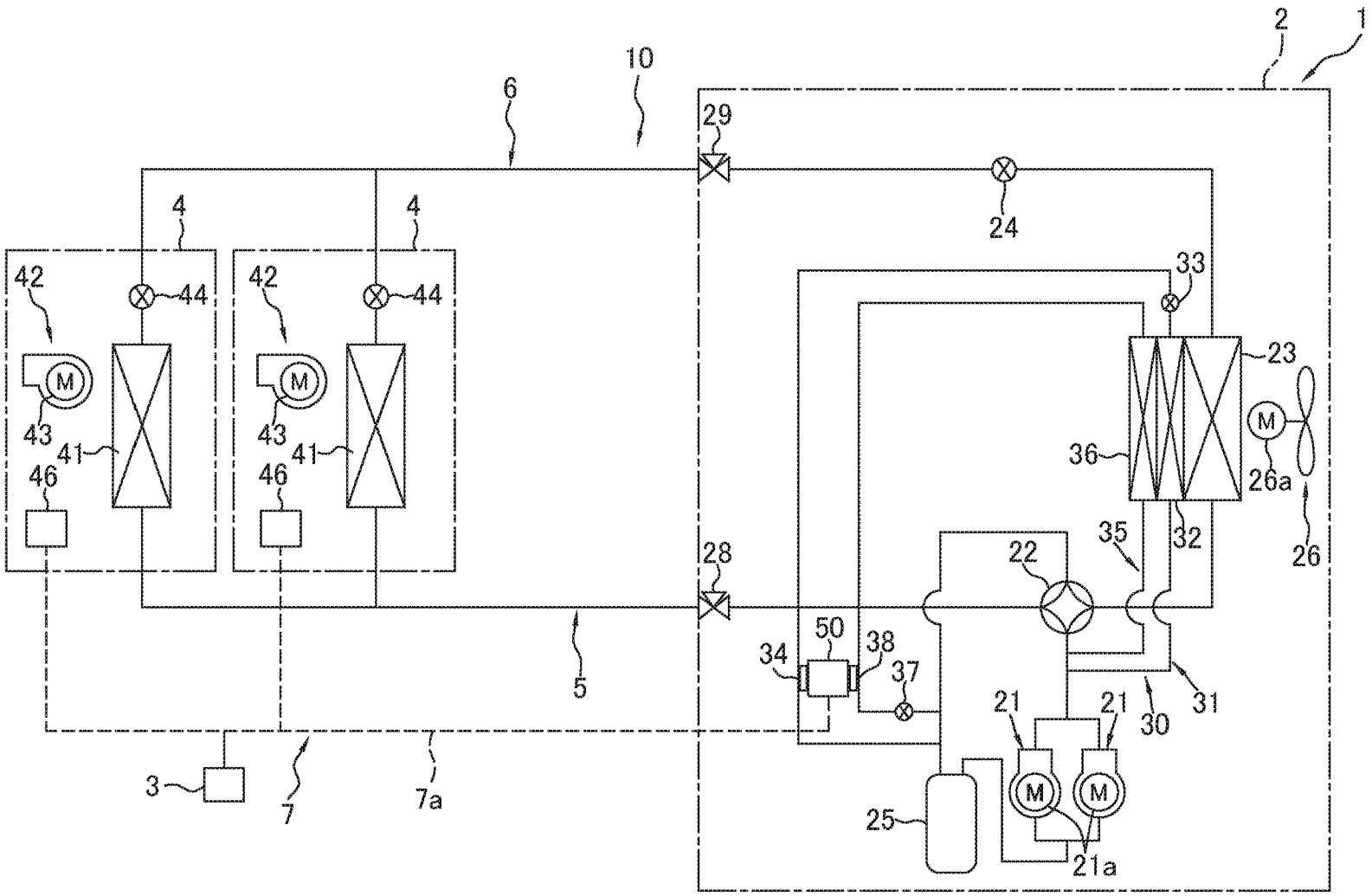
FIG. 1 is an overall configuration diagram of a refrigeration cycle apparatus according to one or more embodiments.

FIG. 1 is a schematic configuration diagram of a refrigeration cycle apparatus 1.

The refrigeration cycle apparatus 1 is used for cooling and heating a room in a building or the like by vapor compression refrigeration cycle operation. The refrigeration cycle apparatus 1 mainly includes an outdoor unit 2 serving as a heat source unit, an indoor unit 4 serving as a utilization unit, and a liquid-side refrigerant communication pipe 6 and a gas-side refrigerant communication pipe 5 that allow communication between the outdoor unit 2 and the indoor unit 4. A refrigerant circuit 10 of the refrigeration cycle apparatus 1 is configured by connecting the outdoor unit 2, the indoor unit 4, the liquid-side refrigerant communication pipe 6, and the gas-side refrigerant communication pipe 5.

Note that the refrigerant circuit 10 according to one or more embodiments is filled with an optional refrigerant such as R410A or R32.

(1-1) Indoor Unit

The indoor unit 4 is installed by being embedded in or suspended from the ceiling of a room in a building or the like, or by being hung on the wall surface of the room. The indoor unit 4 is connected to the outdoor unit 2 through the liquid-side refrigerant communication pipe 6 and the gas-side refrigerant communication pipe 5, and constitutes part of the refrigerant circuit 10.

Note that in the refrigeration cycle apparatus 1 according to one or more embodiments, there are a plurality of the indoor units 4 connected in parallel to each other in the refrigerant circuit 10. Since the indoor units 4 have the same configuration, one of the indoor units 4 will be described below.

The indoor unit 4 mainly has an indoor expansion valve 44, an indoor heat exchanger 41, an indoor fan 42, and an indoor control unit 46.

The indoor heat exchanger 41 is, for example, a cross-fin type fin-and-tube heat exchanger including a heat transfer tube and a large number of fins. The indoor heat exchanger 41 functions as an evaporator for the refrigerant and cools indoor air during cooling operation, and functions as a radiator or condenser for the refrigerant and heats indoor air during heating operation. The gas-side refrigerant communication pipe 5 is connected to the gas side of the indoor heat exchanger 41.

The indoor expansion valve 44 is an electronic expansion valve, the valve opening degree of which is adjustable. The indoor expansion valve 44 is provided in the refrigerant flow path between the indoor heat exchanger 41 and the liquid-side refrigerant communication pipe 6.

The indoor unit 4 has the indoor fan 42 for sucking indoor air into the unit and, after heat exchange between the sucked indoor air and the refrigerant by the indoor heat exchanger 41, supplying the heat-exchanged air as supply air into the room. The indoor fan 42 is a centrifugal fan, a multiblade fan, or the like. The indoor fan 42 has an indoor fan motor 43.

The indoor control unit 46 controls the operation of the components that constitute the indoor unit 4. The indoor control unit 46 has a microcomputer provided to control the indoor unit 4 and including memory such as ROM and RAM, a processor such as a CPU, and the like. The indoor control unit 46 can exchange control signals and the like with an outdoor control unit 50 of the outdoor unit 2 or a remote controller 3 through a transmission line 7*a*.

(1-2) Outdoor Unit

The outdoor unit 2 is installed outside a building or the like, and is connected to the indoor units 4 through the liquid-side refrigerant communication pipe 6 and the gas-side refrigerant communication pipe 5.

Figure 2:
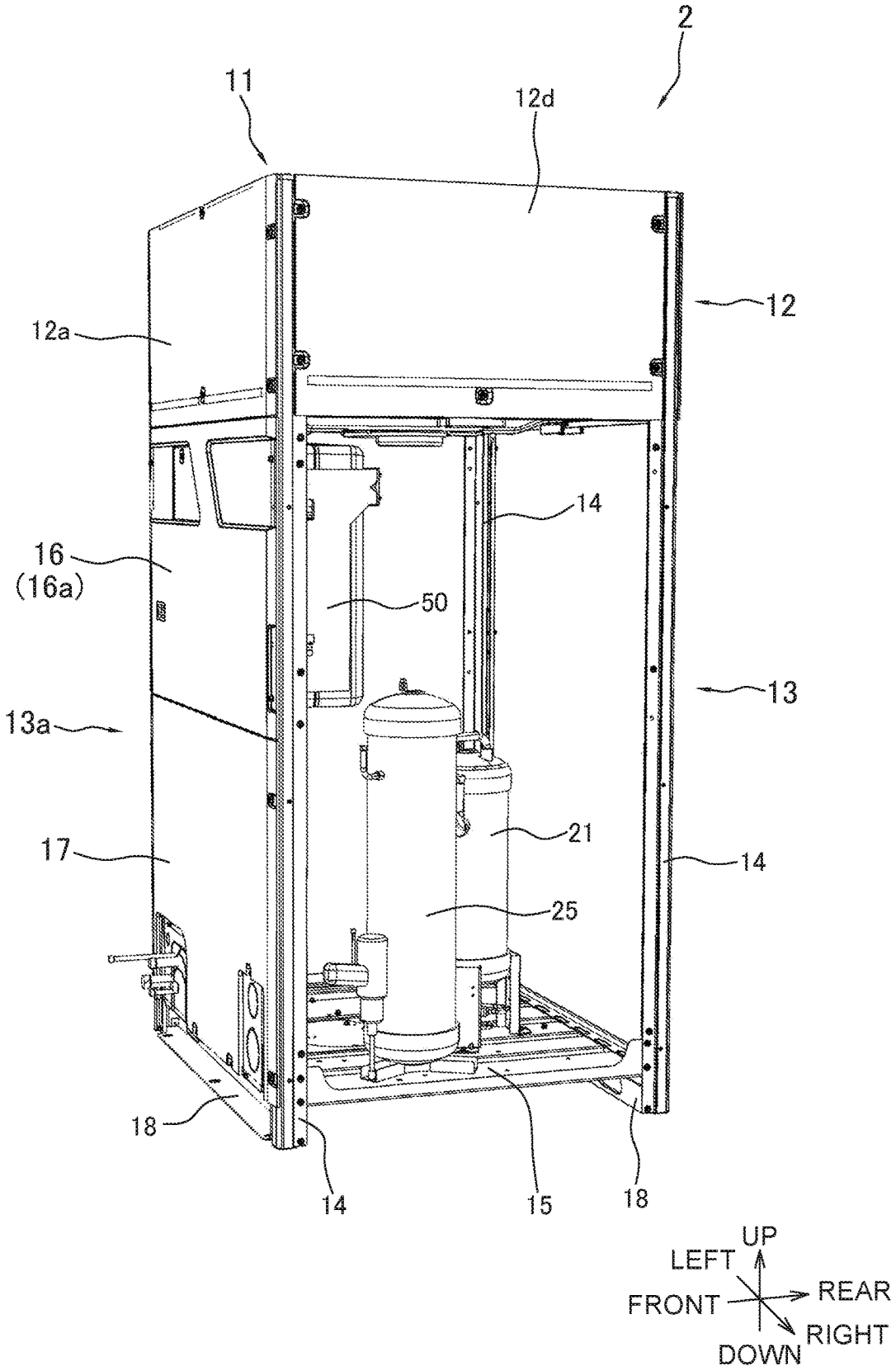
FIG. 2 is an external perspective view of an outdoor unit.
Figure 3:
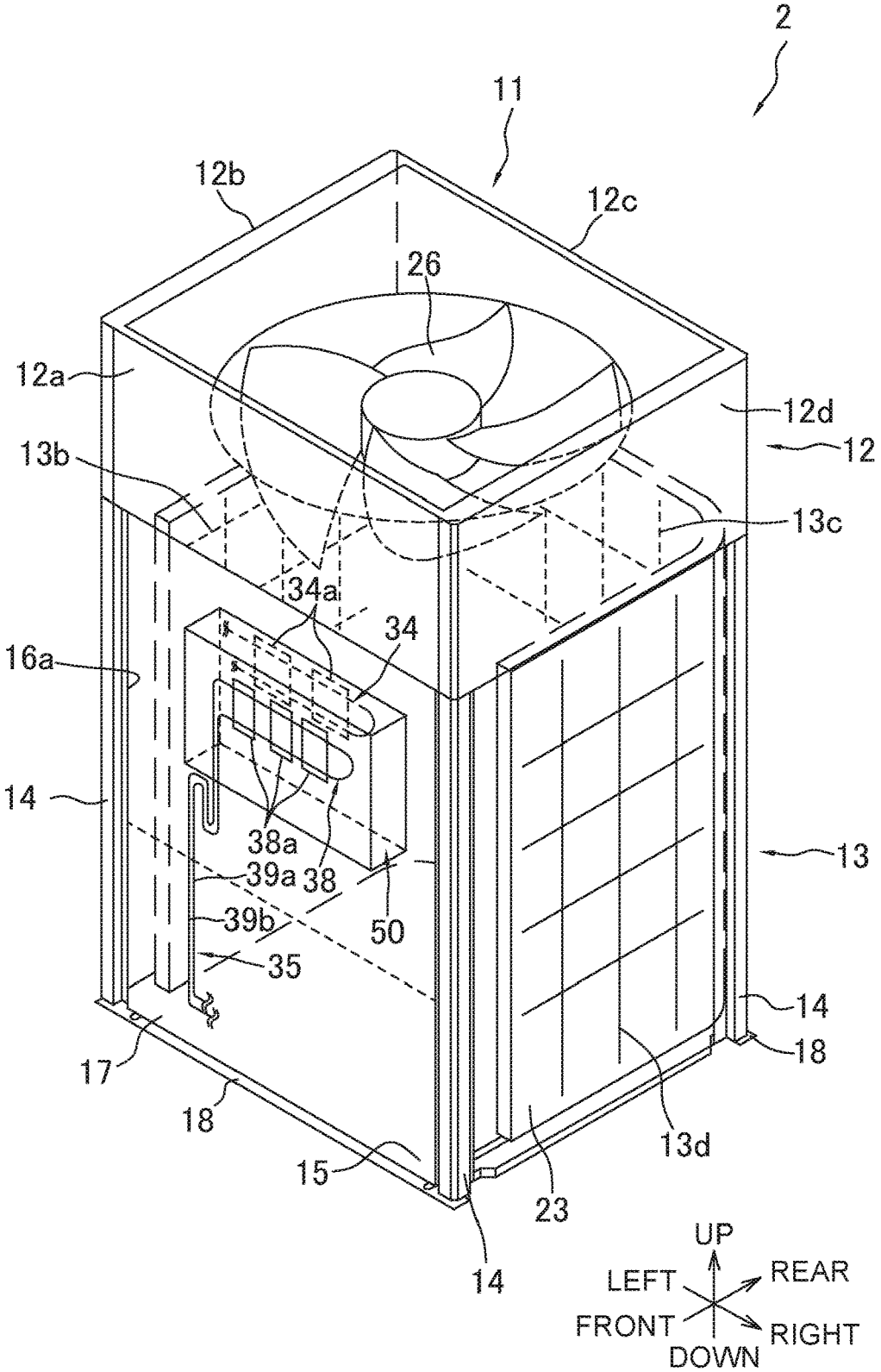
FIG. 3 is a schematic external perspective view illustrating the arrangement and the like of an outdoor control unit in the outdoor unit.

FIG. 2 is an external perspective view of the outdoor unit 2. In FIG. 2, part of the internal configuration of the outdoor unit 2 is omitted. Note that in the following description, unless otherwise specified, "upper", "lower", "left", "right", "front", and "rear" refer to the directions when the outdoor unit 2 illustrated in FIG. 2 is viewed from the front (left oblique front side in the drawing). Here, in one or more embodiments, the direction in which the surface without the outdoor heat exchanger 23 or the surface with the smallest portion where the outdoor heat exchanger 23 is present is located is referred to as "front", as viewed from the center of the outdoor unit 2 in plan view. Note that in FIG. 2, the main equipment and the outdoor control unit 50 inside the outdoor unit 2 are mainly illustrated, and the outdoor heat exchanger 23, other pipes, and the like are omitted. In addition, FIG. 3 is a schematic external perspective view illustrating the arrangement and the like of the outdoor control unit 50 in the outdoor unit 2. In FIG. 3, the outdoor control unit 50, a first cooling portion 34 and second cooling portion 38 in the periphery thereof, the outdoor heat exchanger 23, an outdoor fan 26, and the like are mainly illustrated, and other equipment, pipes, and the like are omitted.

The outdoor unit 2 mainly has an outdoor unit casing 11, a compressor 21, a four-way switching valve 22, the outdoor heat exchanger 23, an outdoor expansion valve 24, an accumulator 25, a liquid-side shutoff valve 29, a gas-side shutoff valve 28, a cooling circuit 30, the outdoor fan 26, the outdoor control unit 50, and the like. In addition, the outdoor unit 2 is provided with various sensors (not illustrated).

In one or more embodiments, the outdoor unit 2 is a top-blowing heat exchange unit that sucks air from the left and right side surfaces and the back surface of the outdoor unit casing 11 and blows the air upward from the upper end surface of the outdoor unit casing 11.

The outdoor unit casing 11 is a heat source casing that houses the components of the outdoor unit 2, and mainly has a main portion 13 and a fan module portion 12 provided on top of the main portion 13.

The main portion 13 has a pair of installation legs 18, a bottom frame 15, four supports 14, a front panel 13*a*, and mesh portions 13*b*, 13*c*, and 13*d*. The installation legs 18 are provided, one on the front side and one on the rear side, and extend in the left-right direction. The bottom frame 15 is bridged over each installation legs 18. The supports 14 extend vertically from the corners of the bottom frame 15. The front panel 13*a* extends between the two supports 14 on the front side. The mesh portion 13*b* is provided so as to extend forward and backward between the supports 14 on the left side. The mesh portion 13*c* is provided so as to extend to the left and right between the supports 14 on the rear side. The mesh portion 13*d* is provided so as to extend forward and backward between the supports 14 on the right side.

The bottom frame 15 forms the bottom of the outdoor unit casing 11, and the outdoor heat exchanger 23 is provided on the bottom frame 15. Here, the outdoor heat exchanger 23 has a substantially U-shape in plan view facing the back surface and both left and right side surfaces of the outdoor unit casing 11.

Note that each of the mesh portions 13*b*, 13*c*, and 13*d* is provided so as to extend along the outer surface of the outdoor heat exchanger 23. These mesh portions 13*b*, 13*c*, and 13*d* substantially form three suction ports on the right side surface, left side surface, and back surface in the outdoor unit casing 11.

The front panel 13*a* has an upper front panel 16 constituting the upper portion of the front surface of the outdoor unit casing 11 and a lower front panel 17 constituting the lower portion of the front surface of the outdoor unit casing 11. The upper front panel 16 is removed at the time of maintenance or the like of the outdoor control unit 50. The lower front panel 17 is removed at the time of maintenance or the like of the compressor 21 located below the lower end (i.e., bottom end) of the outdoor control unit 50.

The fan module portion 12 is attached to the upper ends of each supports 14. The fan module portion 12 is a substantially rectangular parallelepiped box having a front side plate 12*a*, a left side plate 12*b*, a back side plate 12*c*, and a right side plate 12*d*, and penetrates in the vertical direction. The fan module portion 12 houses the outdoor fan 26 therein to form a flow path for an upward air flow.

The compressor 21 is, for example, a positive-displacement compressor driven by a compressor motor 21*a*. In one or more embodiments, two compressors 21 are connected in parallel to each other. The compressor motor 21*a* is driven with power supplied through an inverter device. The operating capacity of the compressor 21 is variable by changing the drive frequency of the compressor motor 21*a* and varying the rotational speed. The discharge side of the compressor 21 is connected to one of a plurality of connection ports of the four-way switching valve 22. In one or more embodiments, the compressor 21 is placed on the bottom frame 15.

The accumulator 25 is a refrigerant reservoir provided between the suction side of the compressor 21 and one of the plurality of connection ports of the four-way switching valve 22. In one or more embodiments, the accumulator 25 is placed on the bottom frame 15.

The outdoor heat exchanger 23 is, for example, a cross-fin type fin-and-tube heat exchanger including a plurality of heat transfer tubes and a plurality of fins. The outdoor heat exchanger 23 functions as a radiator or condenser for the refrigerant during the cooling operation, and functions as an evaporator for the refrigerant during the heating operation. One of the plurality of connection ports of the four-way switching valve 22 is connected to the gas side of the outdoor heat exchanger 23 through a refrigerant pipe. The outdoor expansion valve 24 is connected to the liquid side of the outdoor heat exchanger 23 through the refrigerant pipe.

The outdoor fan 26 is housed in the fan module portion 12. The outdoor fan 26 sucks outdoor air from around the lower portion of the outdoor unit casing 11 into the interior, thereby forming an air flow that, after heat exchange with the refrigerant in the outdoor heat exchanger 23, is discharged upward from a blow-out port that is provided on the upper end surface of the fan module portion 12. The outdoor fan 26 is a propeller fan or the like driven by an outdoor fan motor 26*a*, which is a DC fan motor, and has a variable air volume. In one or more embodiments, the outdoor fan motor 26*a* is driven with power supplied through an inverter device.

The outdoor expansion valve 24 is an electric expansion valve, the valve opening degree of which is adjustable in order to adjust the flow rate of the refrigerant flowing in the refrigerant circuit 10. The outdoor expansion valve 24 is provided between the liquid-side outlet of the outdoor heat exchanger 23 and the liquid-side shutoff valve 29.

The four-way switching valve 22 has the plurality of connection ports. The four-way switching valve 22 switches the refrigerant circuit 10 between a cooling operation connection state and a heating operation connection state by switching the connection state of the plurality of connection ports. In the cooling operation connection state, the discharge side of the compressor 21 is connected to the outdoor heat exchanger 23, and the suction side of the compressor 21 is connected to the gas-side shutoff valve 28. In the heating operation connection state, the discharge side of the compressor 21 is connected to the gas-side shutoff valve 28, and the suction side of the compressor 21 is connected to the outdoor heat exchanger 23.

The liquid-side shutoff valve 29 is provided at a connecting port with the liquid-side refrigerant communication pipe 6. The liquid-side shutoff valve 29 is connected to the outdoor expansion valve 24 on the opposite side of the outdoor heat exchanger 23 side through the refrigerant pipe. The gas-side shutoff valve 28 is provided at a connecting port with the gas-side refrigerant communication pipe 5. The gas-side shutoff valve 28 is connected to one of the plurality of connection ports of the four-way switching valve 22 through the refrigerant pipe.

The cooling circuit 30 is used to cool the electric components such as heat-generating components, to be described later, of the outdoor control unit 50, and has a first cooling circuit 31 and a second cooling circuit 35.

The first cooling circuit 31 branches from between the discharge side of the compressor 21 and one of the plurality of connection ports of the four-way switching valve 22, and causes the refrigerant to flow to merge between one of the plurality of connection ports of the four-way switching valve 22 and the accumulator 25. The first cooling circuit 31 has a first heat exchanger 32, a first expansion valve 33, and the first cooling portion 34. The first heat exchanger 32, the first expansion valve 33, and the first cooling portion 34 are provided such that the refrigerant flows in this order in the first cooling circuit 31. Note that in one or more embodiments, the first heat exchanger 32 is integrated with the outdoor heat exchanger 23 and a second heat exchanger 36 to be described later by sharing the heat transfer fins. The first expansion valve 33 is an electric expansion valve, the valve opening degree of which is adjustable in order to adjust the flow rate of the refrigerant flowing in the first cooling circuit 31. The first cooling portion 34 is provided so as to cool the space where the electric components such as heat-generating components of the outdoor control unit 50 are housed, from the back side of the outdoor control unit 50 with a first heat transfer member 34*a* described later interposed therebetween.

The second cooling circuit 35 branches from between the discharge side of the compressor 21 and one of the plurality of connection ports of the four-way switching valve 22, and causes the refrigerant to flow to merge between one of the plurality of connection ports of the four-way switching valve 22 and the accumulator 25. The second cooling circuit 35 has the second heat exchanger 36, the second cooling portion 38, and a second expansion valve 37. The second heat exchanger 36, the second cooling portion 38, and the second expansion valve 37 are provided such that the refrigerant flows in this order in the second cooling circuit 35. Note that in one or more embodiments, the second heat exchanger 36 is integrated with the outdoor heat exchanger 23 and the first heat exchanger 32 by sharing the heat transfer fins. The second expansion valve 37 is an electric expansion valve, the valve opening degree of which is adjustable in order to adjust the flow rate of the refrigerant flowing in the second cooling circuit 35. The second cooling portion 38 is provided to cool the electric components such as heat-generating components of the outdoor control unit 50 while being in thermal contact therewith from the front side with second heat transfer members 38*a* described later interposed therebetween.

Note that although details will be described later, when constructing the outdoor unit 2 or performing maintenance on the outdoor control unit 50 and the like of the outdoor unit 2, first, as illustrated in the schematic sectional side views of FIGS. 6 and 7, the upper front panel 16 of the outdoor unit casing 11 is removed, and then the upper front lid 51 and the lower front lid 52 of the electric component casing 50*a* described later are removed to open an electric component maintenance opening 50*x*. This allows access to the electric component maintenance opening 50*x* from the direction indicated by arrow D1 in FIG. 7 to maintain a fourth board 64 and a fifth board 65, which will be described later, in the outdoor control unit 50.

Figure 4:
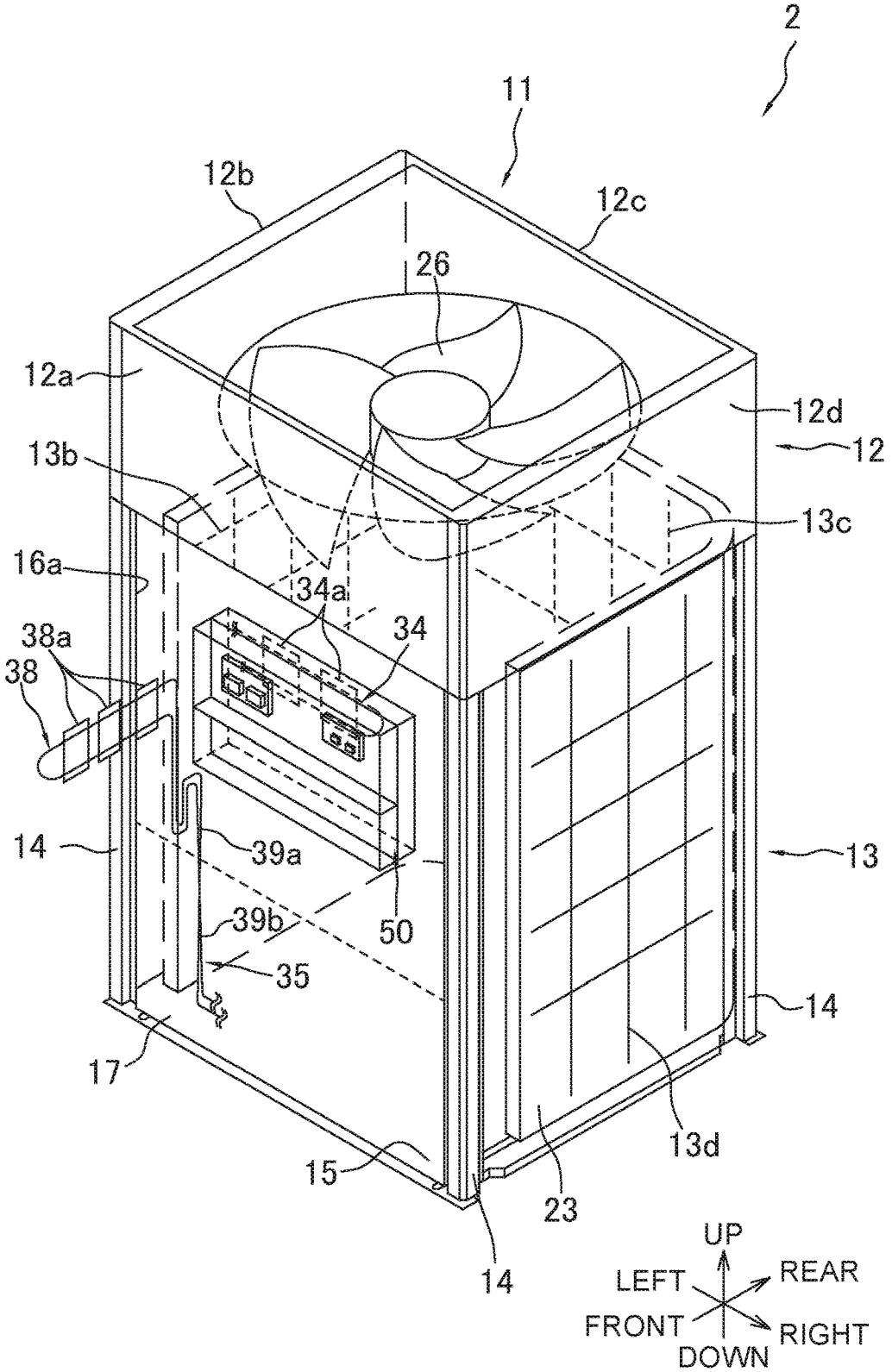
FIG. 4 is a schematic external perspective view illustrating a second cooling portion moved (i.e., first state).

Next, as illustrated in FIG. 4, the second cooling portion 38 of the second cooling circuit 35 is moved forward. Specifically, by rotating in a twisting manner the first connection pipe 39*a* and the second connection pipe 39*b* extending from both ends of the second cooling portion 38, the second cooling portion 38 is rotated out to the front.

Figure 5:
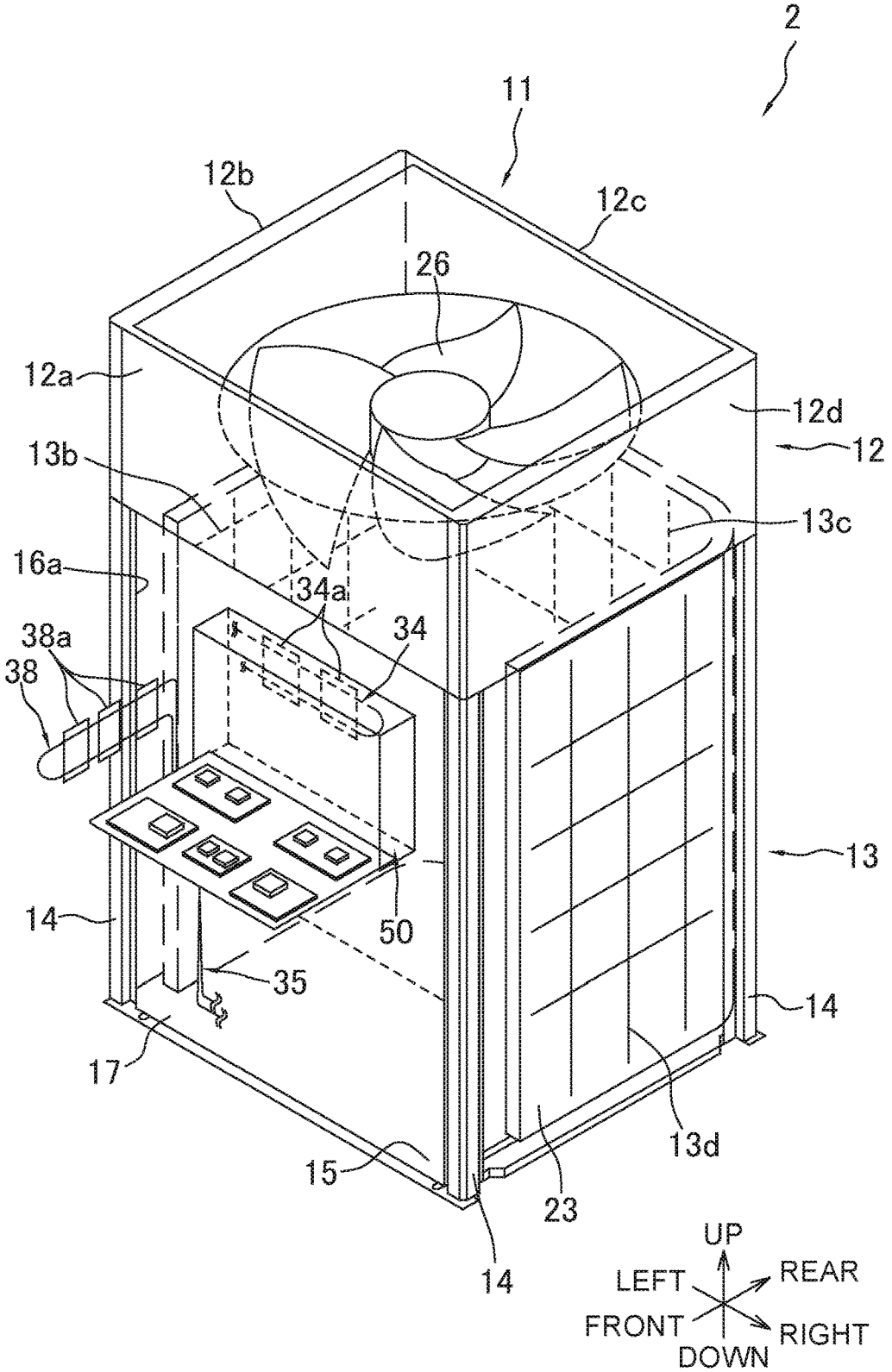
FIG. 5 is a schematic external perspective view illustrating the outdoor control unit with a mounting plate, electric components, and the like rotated out to the front (i.e., second state).
Figure 8:
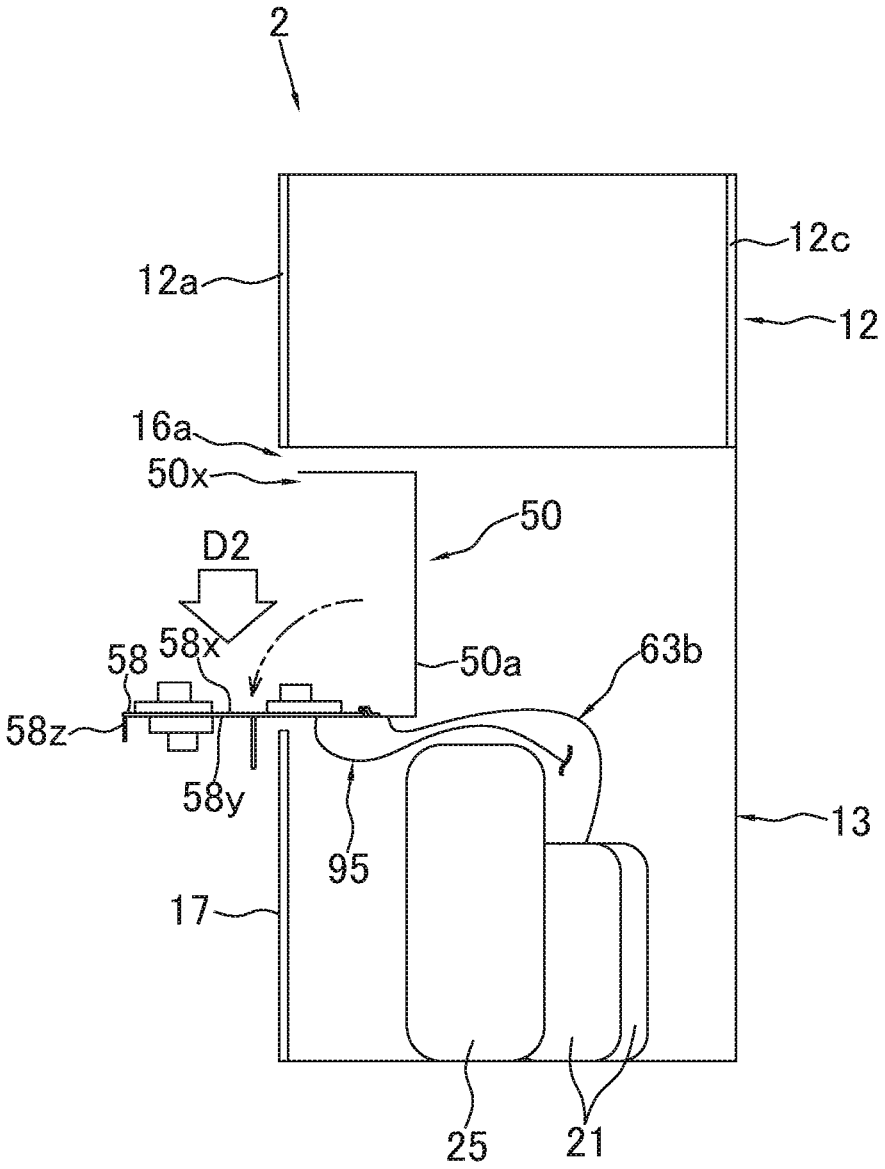
FIG. 8 is a schematic sectional side view illustrating the outdoor control unit with a mounting plate, electric components, and the like rotated out to the front (i.e., second state).

Thus, as illustrated in the schematic external perspective view of FIG. 5 and the schematic sectional side views of FIGS. 8 and 9, a mounting plate 58, described below, of the outdoor control unit 50 and electric components integrated with the mounting plate 58 can be rotated out to the electric component maintenance opening 50*x* side. This allows access to the first board 61, the second board 62, and the third board 63, which will be described later, in the outdoor control unit 50 from the direction indicated by arrow D2 in FIG. 8 to maintain the first board 61, the second board 62, and the third board 63 from above.

The outdoor control unit 50 is provided in the outdoor unit casing 11, below the fan module portion 12, close to the front side, and facing the back side of the upper front panel 16. More specifically, the outdoor control unit 50 is located forward of the compressor 21 and the accumulator 25, and is disposed above the upper end of the compressor 21. Since the compressor 21 is provided below the lower end of the outdoor control unit 50, when performing maintenance on the compressor 21, it is possible to access the compressor 21 by removing the lower front panel 17 from the outdoor unit casing 11, and the outdoor control unit 50 does not become an obstacle when accessing the compressor 21. As illustrated in FIG. 7, the outdoor control unit 50 can be accessed by a local worker through an opening 16*a* serving as a heat source maintenance opening that is exposed when the upper front panel 16 of the outdoor unit casing 11 is removed. Note that the opening 16*a* is bordered by the support 14 located at the left front, the support 14 located at the right front, the lower edge of the front side plate 12*a* of the fan module portion 12, and the upper edge of the lower front panel 17, and is open in the front-rear direction. The outdoor control unit 50 controls the operation of the components that constitute the outdoor unit 2. The outdoor control unit 50 has a microcomputer provided to control the outdoor unit 2 and including memory such as ROM and RAM, a processor such as a CPU, and the like, and controls the states of the compressor motor 21*a*, the outdoor fan motor 26*a*, the outdoor expansion valve 24, the four-way switching valve 22, the first expansion valve 33, the second expansion valve 37, and the like. The outdoor control unit 50 can exchange control signals and the like with the indoor control units 46 of the indoor units 4 and the remote controller 3 through the transmission line 7*a*. The above-described indoor control units 46, outdoor control unit 50, and remote controller 3 are connected to each other by the transmission line 7*a* to constitute a control unit 7 that controls the operation of the entire refrigeration cycle apparatus 1.

The control unit 7 is connected to receive detection signals from various sensors (not illustrated), and controls various equipment on the basis of these detection signals or the like. Note that the control unit 7 has a processor such as a CPU that executes the above-described various controls, memory such as ROM or RAM that stores information used for executing the various controls, and the like.

(1-3) Refrigerant Communication Pipe

The liquid-side refrigerant communication pipe 6 and the gas-side refrigerant communication pipe 5 are refrigerant pipes that are constructed on site when installing the refrigeration cycle apparatus 1 in an installation place such as a building.

Note that, in the refrigeration cycle apparatus 1 according to one or more embodiments having the plurality of indoor units 4, the liquid-side refrigerant communication pipe 6 has a branch portion corresponding to each of the indoor units, and the gas-side refrigerant communication pipe 5 has a branch portion corresponding to each of the indoor units.

(2) Refrigeration Cycle in Refrigerant Circuit

The refrigerant circuit 10 of the refrigeration cycle apparatus 1 mainly performs cooling operation and heating operation by switching the connection state of the four-way switching valve 22. Here, the operation of the portion of the refrigerant circuit 10 other than the cooling circuit 30 will be described.

(2-1) Cooling Operation

The cooling operation is performed in a state where the connection state of the four-way switching valve 22 is switched such that the discharge side of the compressor 21 is on the outdoor heat exchanger 23 side and the suction side of the compressor 21 is on each of the indoor heat exchanger 41 side.

The compressor 21 is frequency controlled, for example, to process the cooling load in each of the indoor units 4. As a result, the low-pressure refrigerant sucked into the compressor 21 is discharged from the compressor 21 to become high-pressure refrigerant, which flows through the four-way switching valve 22 into the outdoor heat exchanger 23.

The refrigerant flowing into the outdoor heat exchanger 23 radiates heat and condenses. The refrigerant flowing out of the outdoor heat exchanger 23 passes through the outdoor expansion valve 24, which is controlled to be fully open by the control unit 7 during the cooling operation.

The refrigerant that has passed through the outdoor expansion valve 24 passes through the liquid-side shutoff valve 29 and is sent to the liquid-side refrigerant communication pipe 6.

The refrigerant flowing through the liquid-side refrigerant communication pipe 6 is branched and then sent to each of the indoor units 4.

The refrigerant flowing into each of the indoor units 4 is decompressed by the indoor expansion valve 44 until reaching a low pressure of the refrigeration cycle. Note that the control unit 7 controls the valve opening degree of the indoor expansion valve 44 such that, for example, the degree of superheating of the refrigerant on the outlet side of the indoor heat exchanger 41 becomes a predetermined target degree of superheating.

The refrigerant decompressed by the indoor expansion valves 44 of the indoor units 4 evaporates in the indoor heat exchangers 41. The flows of the refrigerant evaporated in the indoor heat exchangers 41 join together, and then flow through the gas-side refrigerant communication pipe 5.

The refrigerant flowing through the gas-side refrigerant communication pipe 5 is sucked again into the compressor 21 through the gas-side shutoff valve 28, four-way switching valve 22, and accumulator 25 of the outdoor unit 2.

(2-2) Heating Operation

The heating operation is performed in a state where the connection state of the four-way switching valve 22 is switched such that the discharge side of the compressor 21 is on the indoor heat exchanger 41 side and the suction side of the compressor 21 is on the outdoor heat exchanger 23 side.

The compressor 21 is frequency controlled, for example, to process the heating load in each of the indoor units. As a result, the high-pressure refrigerant discharged from the compressor 21 flows toward the indoor units 4 through the four-way switching valve 22 and the gas-side refrigerant communication pipe 5.

Here, the refrigerant that has passed through the gas-side refrigerant communication pipe 5 branches off and flows into each of the indoor units 4.

The refrigerant flowing into the indoor units 4 radiates heat and condenses in the indoor heat exchangers 41. Note that during the heating operation, the valve opening degree of each of the indoor expansion valves 44 is controlled such that the degree of subcooling of the refrigerant flowing through the outlet of the indoor heat exchanger 41 becomes a predetermined value, for example.

In this way, the flows of the refrigerant condensed in the indoor heat exchangers 41 and passing through the indoor expansion valves 44 join together, and then flow through the liquid-side refrigerant communication pipe 6.

The refrigerant flowing through the liquid-side refrigerant communication pipe 6 is supplied to the outdoor unit 2 through the liquid-side shutoff valve 29. The refrigerant that has passed through the liquid-side shutoff valve 29 is decompressed by the outdoor expansion valve 24 until reaching a low pressure of the refrigeration cycle. Specifically, for example, the valve opening degree of the outdoor expansion valve 24 is controlled such that the degree of superheating of the refrigerant flowing through the suction side of the compressor 21 becomes a target degree of superheating.

The refrigerant sent to the outdoor heat exchanger 23 evaporates and is sucked again into the compressor 21 through the four-way switching valve 22 and the accumulator 25.

(3) Refrigerant Flow in Cooling Circuit

Here, the operation of the cooling circuit 30 in the refrigerant circuit 10 will be described.

The refrigerant can flow through the first cooling circuit 31 and the second cooling circuit 35 of the cooling circuit 30 during both the cooling operation and the heating operation. During both the cooling operation and the heating operation, more specifically, the outdoor control unit 50 may control the valve opening degrees of the first expansion valve 33 and the second expansion valve 37 so that the refrigerant flows to the first cooling circuit 31 and the second cooling circuit 35 at all times when the compressor 21 is driven.

Here, the refrigerant discharged from the compressor 21, and decompressed by first expansion valve 33 after radiating heat in the first heat exchanger 32 is guided to the first cooling portion 34 of the first cooling circuit 31. At least some of the refrigerant flowing through the first cooling portion 34 is evaporated by receiving the heat from the heat-generating components of the outdoor control unit 50, and flows toward the accumulator 25.

In addition, the refrigerant discharged from the compressor 21 and radiating heat in second heat exchanger 36 is guided to the second cooling portion 38 of the second cooling circuit 35. At least some of the refrigerant flowing through the second cooling portion 38 is evaporated by receiving the heat from the heat-generating components of the outdoor control unit 50, is decompressed when passing through the second expansion valve 37, and flows toward the accumulator 25. Therefore, the temperature of the refrigerant flowing through the first cooling portion 34 is different from the temperature of the refrigerant flowing through the second cooling portion 38, and the temperature of the refrigerant flowing through the first cooling portion 34 is lower.

(4) Detailed Configuration of Outdoor Control Unit

Figure 9:
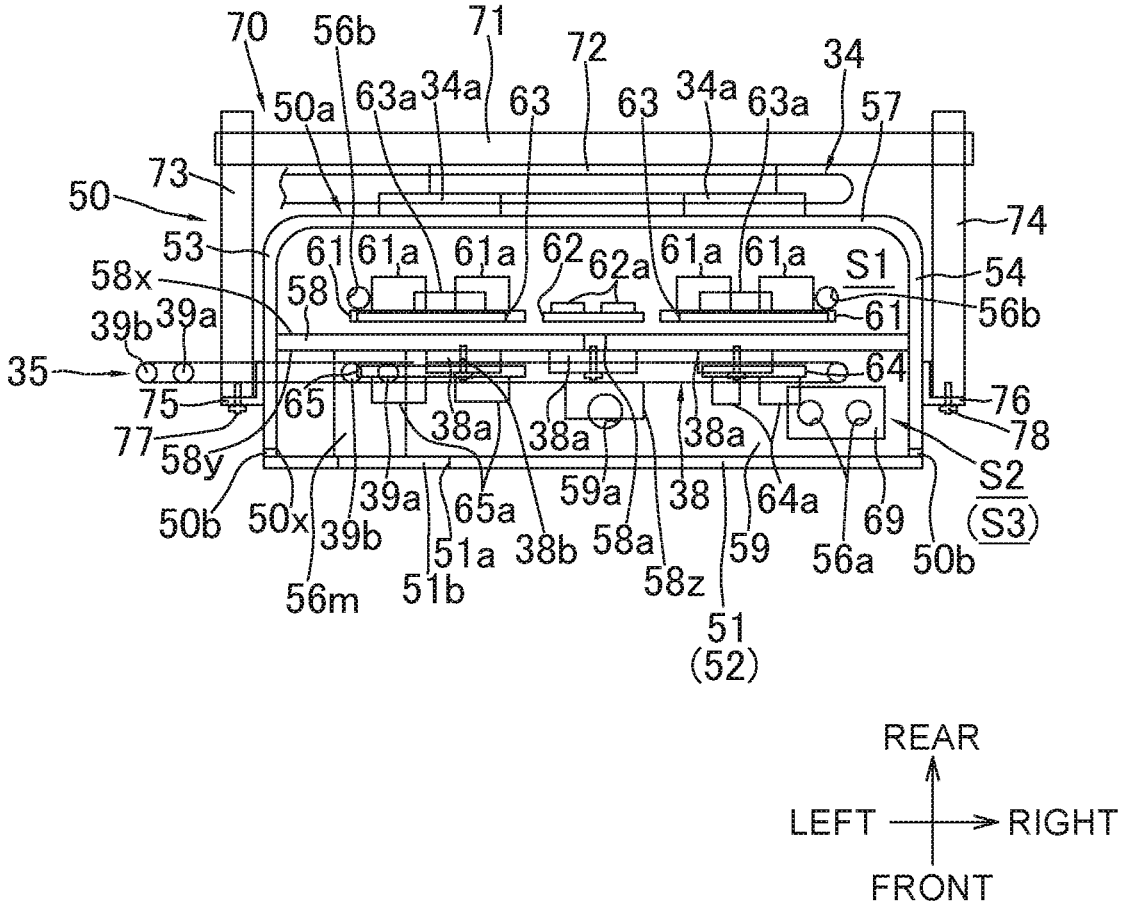
FIG. 9 is a schematic configuration diagram of the interior of the outdoor control unit in plan view.
Figure 10:
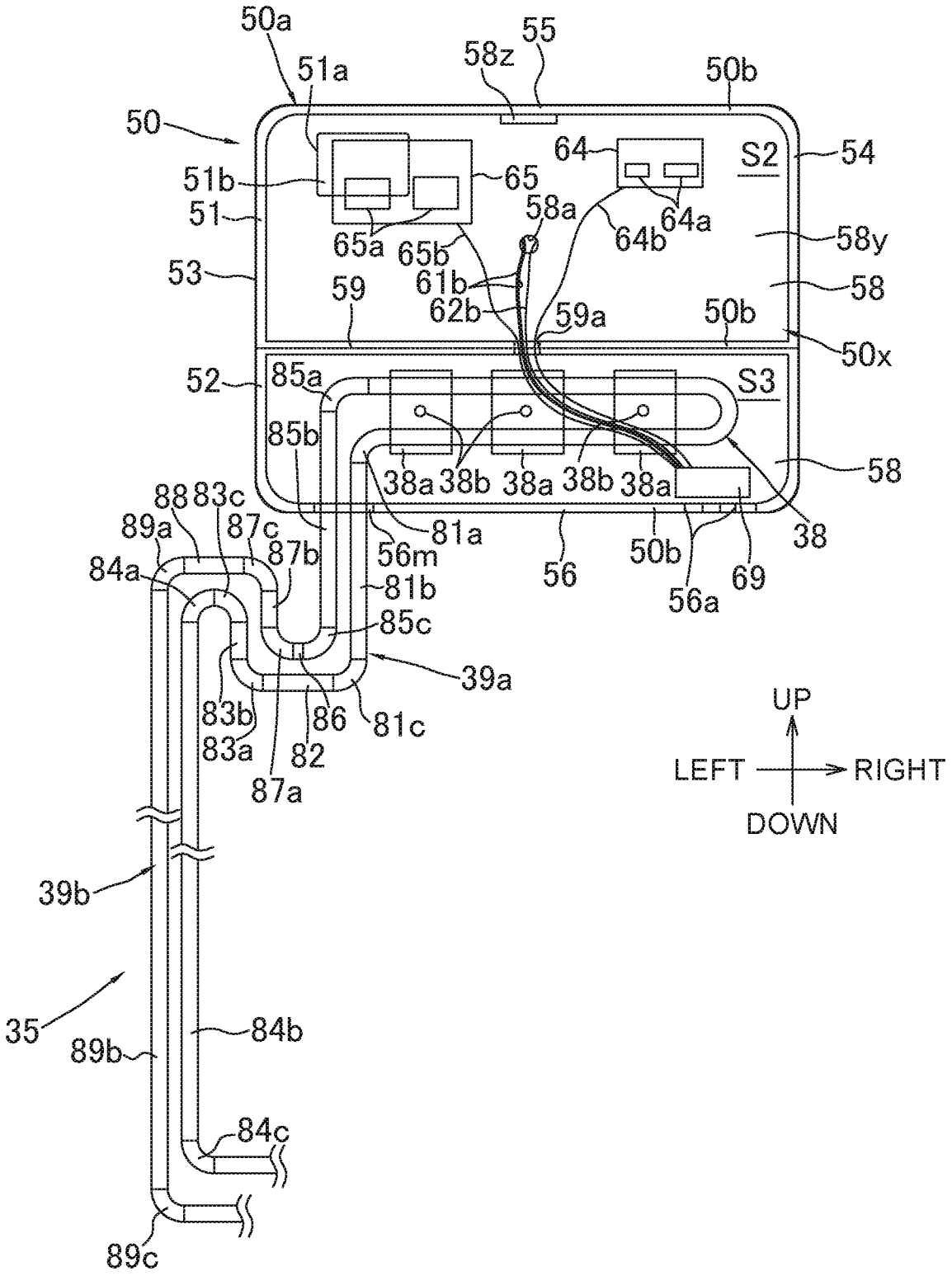
FIG. 10 is a schematic configuration diagram of the front side portion of the interior of the outdoor control unit as viewed from the front.
Figure 11:
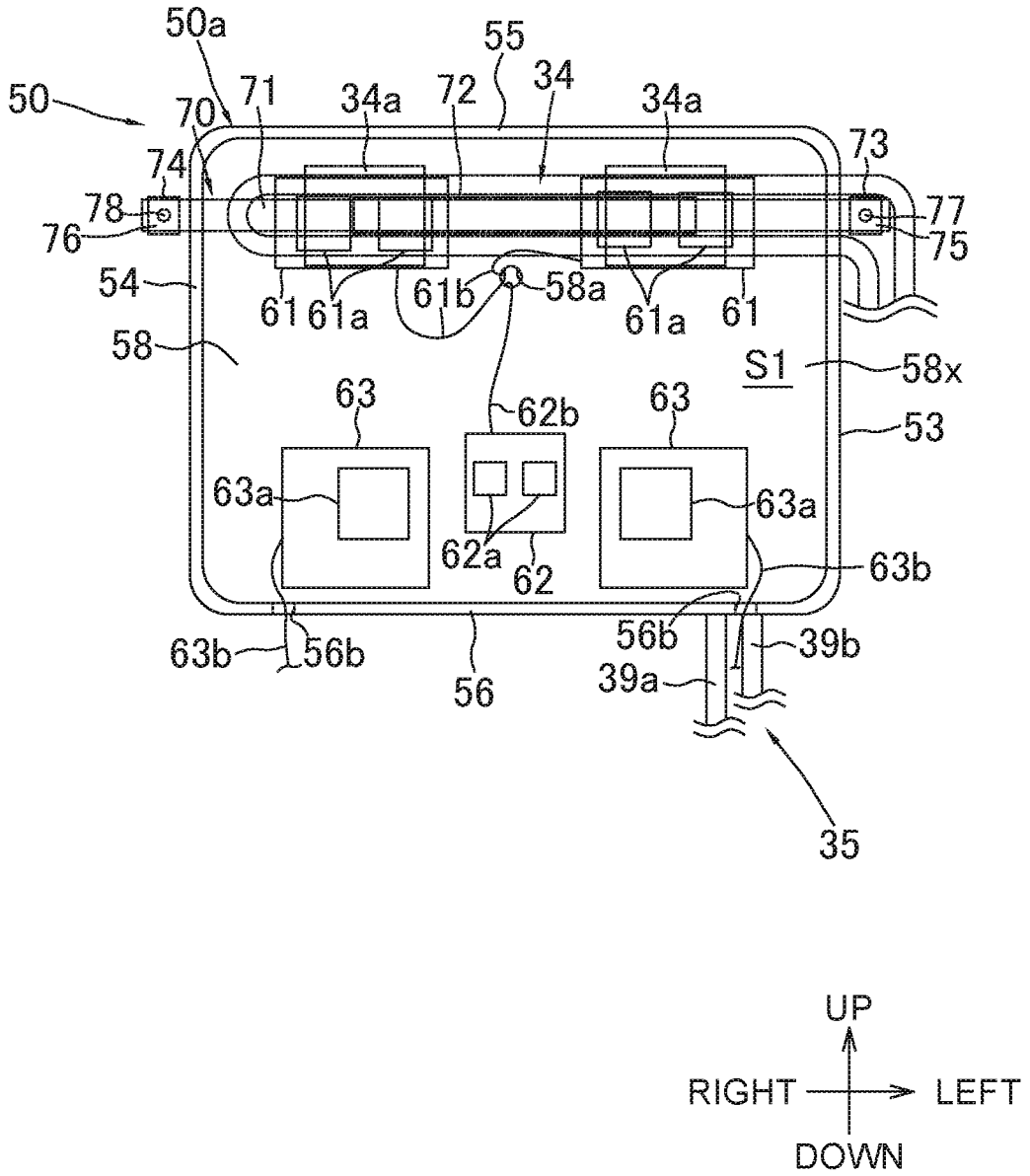
FIG. 11 is a schematic configuration diagram of the back side portion of the interior of the outdoor control unit as viewed from the back.
Figure 12:
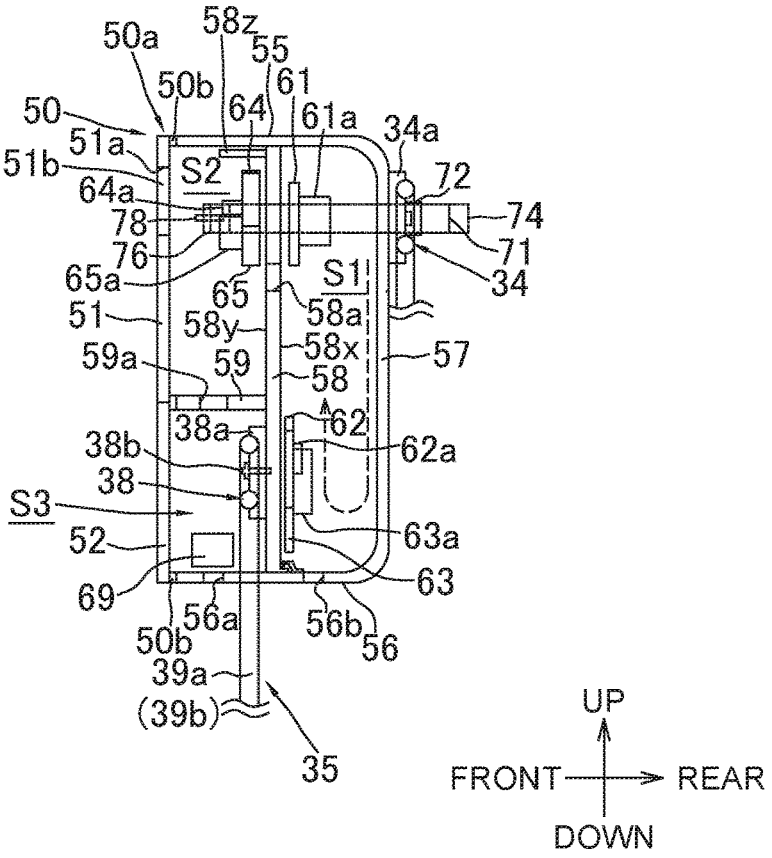
FIG. 12 is a schematic configuration diagram of the interior of the outdoor control unit as viewed from the right side.

FIG. 9 is a schematic configuration diagram of the interior of the outdoor control unit 50 in plan view. FIG. 10 is a schematic configuration diagram of the front side portion of the interior of the outdoor control unit 50 as viewed from the front. FIG. 11 is a schematic configuration diagram of the back side portion of the interior of the outdoor control unit 50 as viewed from the back. FIG. 12 is a schematic configuration diagram of the interior of the outdoor control unit 50 as viewed from the right side.

The outdoor control unit 50 has the electric component casing 50*a*, a lid seal material 50*b*, the upper front lid 51, the lower front lid 52, the mounting plate 58, a partition plate 59, the first board 61, the second board 62, the third board 63, the fourth board 64, and the fifth board 65.

The electric component casing 50*a* has a back surface 57, a top surface 55, a lower surface 56, a right side surface 54, and a left side surface 53. The back surface 57, the top surface 55, the lower surface 56, the right side surface 54, and the left side surface 53 are made of metal. The back surface 57, the top surface 55, the lower surface 56, the right side surface 54, and the left side surface 53 are integrally configured by being coupled so as not to generate a gap by seaming processing.

The electric component casing 50*a* has the electric component maintenance opening 50*x* that opens in the front-rear direction at the front end. The edge of the electric component maintenance opening 50*x* is constituted by the respective front edges of the back surface 57, the top surface 55, the lower surface 56, the right side surface 54, and the left side surface 53. The electric component maintenance opening 50*x* of the electric component casing 50*a* has an upper portion covered by the upper front lid 51 and a lower portion covered by the lower front lid 52. The upper front lid 51 and the lower front lid 52 are both sheet metal having a substantially rectangular shape in a front view, and the upper front lid 51 is positioned on top of the lower front lid 52. Note that the upper front lid 51 has an inspection port 51*a* penetrating therethrough in the plate thickness direction. The inspection port 51*a* is openably closed by an inspection lid 51*b*. When the upper front lid 51 and the lower front lid 52 are attached to the electric component casing 50*a*, a substantially box-shaped body is formed by the back surface 57, the top surface 55, the lower surface 56, the right side surface 54, the left side surface 53, the upper front lid 51, and the lower front lid 52.

The mounting plate 58 extends vertically and horizontally so as to partition the interior of the electric component casing 50*a* into the front side and the rear side. The mounting plate 58 is a rectangular plate-shaped member in a front view, and has a first plane 58*x* facing the back side and a second plane 58*y* facing the front side. Note that the second surface 58*y* of the mounting plate 58 faces the electric component maintenance opening 50*x* of the electric component casing 50*a*. The mounting plate 58 is made of metal, and its periphery is flanged to increase strength. The mounting plate 58 is provided near the center in the interior of the electric component casing 50*a* in the front-rear direction. The first board 61, the second board 62, the third board 63, the fourth board 64, and the fifth board 65 are attached to the mounting plate 58. The partition plate 59 extends horizontally so as to partition the space forward of the mounting plate 58 inside the electric component casing 50*a* into the upper and lower sections. The partition plate 59 is made of metal. The partition plate 59 is provided near the center in the interior of the electric component casing 50*a* in the vertical direction. As a result, the interior of the electric component casing 50*a* is partitioned into a first space S1 behind the mounting plate 58, a second space S2 forward of the mounting plate 58 and above the partition plate 59, and a third space S3 forward of the mounting plate 58 and below the partition plate 59. Note that a handle 58*z* extending toward the front is provided at the upper end near the center of the second plane 58*y* of the mounting plate 58 in the left-right direction. By pulling the handle 58*z* toward the front side, the mounting plate 58 can be pivotally rotated forward.

Figure 13:
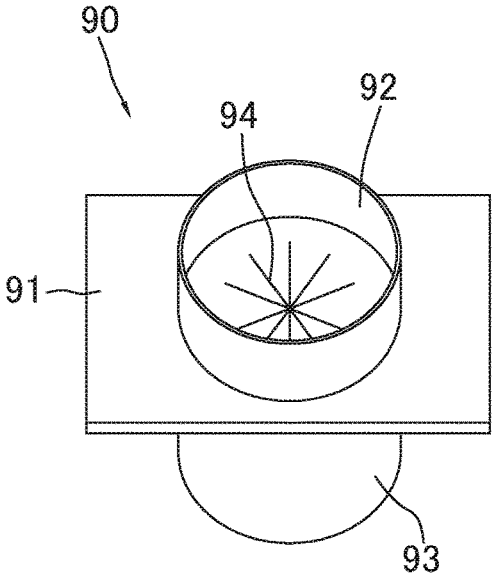
FIG. 13 is a schematic external perspective view of a wire seal material.

Note that the partition plate 59 has a first opening 59*a* penetrating therethrough in the vertical direction so as to allow communication between the second space S2 and the third space S3. In addition, the mounting plate 58 has a second opening 58*a* penetrating therethrough in the front-rear direction so as to allow communication between the first space S1 and the second space S2. Note that the mounting plate 58 is not provided with an opening that allows direct communication between the first space S1 and the third space S3. A wire seal material 90 illustrated in FIG. 13 is attached to the first opening 59*a* of the partition plate 59.

The lower surface 56 of the electric component casing 50*a* has an opening 56*b* behind the mounting plate 58, the opening 56*b* allowing communication between the first space S1 and the external space below the electric component casing 50*a*. An electric wire 63*b* extending from an IPM provided on the third board 63 as described later passes through the opening 56*b*. The wire seal material 90 illustrated in FIG. 13 is attached to the opening 56*b* of the lower surface 56. Note that any elastic member can be used as the wire seal material 90, but in one or more embodiments, a rubber bush is used.

Note that the lower surface 56 of the electric component casing 50*a* has a movable surface 56*m* forward of the mounting plate 58 and in the vicinity of the left end. The movable surface 56*m* is formed with an opening for allowing the first connection pipe 39*a* and second connection pipe 39*b* described later, which are connected to the ends of the second cooling portion 38 of the second cooling circuit 35, to penetrate through in the vertical direction. The movable surface 56*m* can be separated from the lower surface 56 by sliding forward together with the first connection pipe 39*a* and the second connection pipe 39*b*.

The wire seal material 90 has a partition portion 91, a first cylindrical portion 92, a second cylindrical portion 93, and a communication portion 94, and is made of a flexible material such as rubber. The partition portion 91 has a substantially rectangular plate shape. The first cylindrical portion 92 is provided so as to extend out from the flat portion of the partition portion 91. The second cylindrical portion 93 is provided so as to extend out from the flat portion of the partition portion 91 to the opposite side to the first cylindrical portion 92 side. The communication portion 94 is provided in the partition portion 91 at a position connecting the inside of the first cylindrical portion 92 to the inside of the second cylindrical portion 93, and has a plurality of cuts radially provided so as to penetrate the partition portion 91 in the thickness direction. The wire seal material 90 is attached to the partition plate 59 by fitting either the first cylindrical portion 92 or the second cylindrical portion 93 inside the first opening 59*a*.

Note that similarly, the wire seal material 90 illustrated in FIG. 13 is attached to the second opening 58*a* of the mounting plate 58. The wire seal material 90 is attached to the mounting plate 58 by fitting either the first cylindrical portion 92 or the second cylindrical portion 93 inside the second opening 58*a*.

The upper front lid 51 is fitted into the front edges of the top surface 55, right side surface 54, and left side surface 53 of the electric component casing 50*a* and the front edge of the partition plate 59. Note that the top surface 55, the lower surface 56, the right side surface 54, the left side surface 53, and the partition plate 59 are provided with the lid seal material 50*b* to border the respective front edges. The lid seal material 50*b* may be, for example, a packing formed from rubber or the like provided along each of the front edges. The packing may be a U-shaped packing that sandwiches the edge.

The lower front lid 52 is fitted into the front edges of the lower surface 56, right side surface 54, and left side surface 53 of the electric component casing 50*a* and the front edge of the partition plate 59. Similarly, the lower front lid 52 is provided with the above-described lid seal material 50*b*, so that when the lower front lid 52 is attached, the gap between the lower front lid 52 and the respective front edges of the lower surface 56, right side surface 54, left side surface 53, and partition plate 59 is filled, and the hermeticity of the third space S3 can be enhanced.

Note that, of the surfaces constituting the outer periphery of the electric component casing 50*a*, the back surface 57 is the widest surface. The length of the back surface 57 in the left-right direction is longer than the length of the left side surface 53 in the front-rear direction, and is longer than the length of the right side surface 54 in the front-rear direction. Therefore, the first cooling portion 34 of the first cooling circuit 31 can ensure a sufficiently long region in the left-right direction for thermal contact with the back surface 57 of the electric component casing 50*a*.

Figure 15:
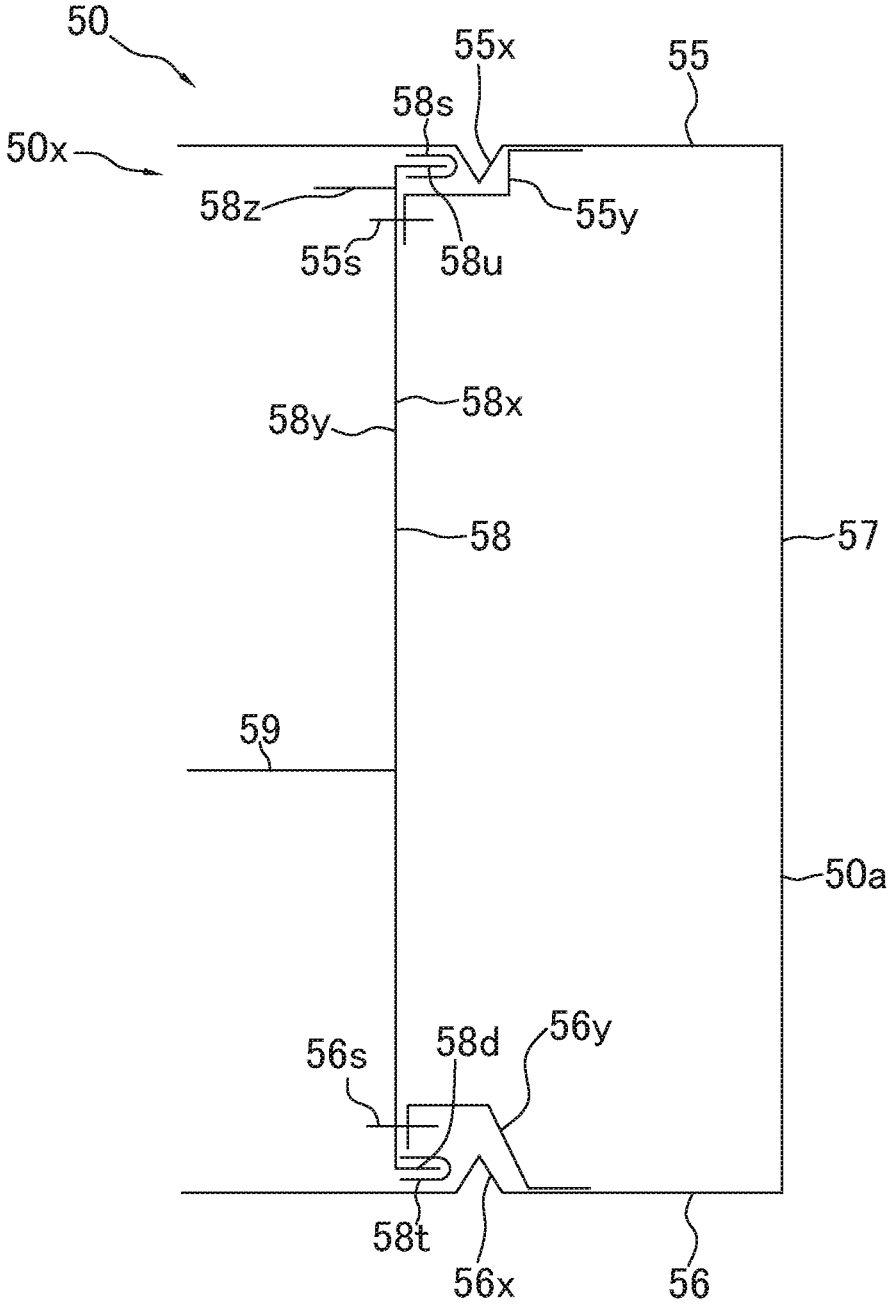
FIG. 15 is a simplified sectional side view of the outdoor control unit (i.e., first state).

FIG. 15 is a simplified sectional side view of the outdoor control unit 50. Here, the state (i.e., first state) in which the mounting plate 58 is fixed to the electric component casing 50*a* is briefly illustrated with the boards and the electric components omitted.

The top surface 55 of the electric component casing 50*a* is formed with a protrusion 55*x* extending left and right in the vicinity of the center in the front-rear direction and protruding downward. A fixation member 55*y* is welded and fixed to the lower side of the top surface 55 further backward than the protrusion 55*x*. The fixation member 55*y* is configured so as to extend downward from the welded fixation region, then extend forward to a point forward of the protrusion 55*x*, and then extend further downward.

The lower surface 56 of the electric component casing 50*a* is formed with a protrusion 56*x* extending to the left and right in the vicinity of the center in the front-rear direction and protruding upward. A fixation member 56*y* is welded and fixed to the upper side of the lower surface 56 further backward than the protrusion 56*x*. The fixation member 56*y* is configured so as to extend in the forward upward direction from the welded fixation region to above the protrusion 56*x*, then extend forward to a point forward of the protrusion 56*x*, and then extend further downward. The fixation member 56*y* is made of a material that is thicker or stronger than the sheet metal portion constituting the lower surface 56 of the electric component casing 50*a*.

The mounting plate 58 has an upper surface portion 58*u* extending from the upper end to the back side and a lower surface portion 58*d* extending from the lower end to the back side.

The upper surface portion 58*u* is normally located at the same height as the protrusion 55*x* of the top surface 55 of the electric component casing 50*a*. The upper surface portion 58*u* is provided with a seal material 58*s* for filling a gap between the upper surface portion 58*u* and the top surface 55 of the electric component casing 50*a*. Specifically, the seal material 58*s* is interposed between the rear end of the upper surface portion 58*u* of the mounting plate 58 and the front portion of the protrusion 55*x* of the top surface 55 of the electric component casing 50*a*. In one or more embodiments, the seal material 58*s* is a U-shaped packing. The upper portion of the mounting plate 58 and the front end of the fixation member 55*y*, which is fixed to the top surface 55 of the electric component casing 50*a*, have portions overlapping in the front-rear direction, and are fixed to each other by a spiral 55*s*. When fixed by the spiral 55*s*, the upper surface portion 58*u* of the mounting plate 58 is urged rearward and pressed against the protrusion 55*x* of the top surface 55 with the seal material 58*s* interposed therebetween. The lower surface portion 58*d* is normally located at the same height as the protrusion 56*x* of the lower surface 56 of the electric component casing 50*a*. The lower surface portion 58*d* is provided with a seal material 58*t* for filling a gap between the lower surface portion 58*d* and the lower surface 56 of the electric component casing 50*a*. Specifically, the seal material 58*t* is interposed between the rear end of the lower surface portion 58*d* of the mounting plate 58 and the front portion of the protrusion 56*x* of the lower surface 56 of the electric component casing 50*a*. In one or more embodiments, the seal material 58*t* is a U-shaped packing. The lower portion of the mounting plate 58 and the front end of the fixation member 56*y*, which is fixed to the lower surface 56 of the electric component casing 50*a*, have portions overlapping in the front-rear direction, and are fixed to each other by a spiral 56*s*. When fixed by the spiral 56*s*, the lower surface portion 58*d* of the mounting plate 58 is urged rearward and pressed against the protrusion 56*x* of the lower surface 56 with the seal material 58*t* interposed therebetween.

The first board 61, the second board 62, the third board 63, the fourth board 64, and the fifth board 65 are all plate-shaped members extending vertically and horizontally, have a substantially rectangular shape in a front view, and are fixed to the mounting plate 58. Specifically, the two first boards 61 are provided in one or more embodiments, are located separately on the left and right above the first space S1, and are provided so as to be plane-parallel on the first plane 58*x* of the mounting plate 58. The two third boards 63 are provided in one or more embodiments, are located separately on the left and right below the first space S1, and are provided so as to be plane-parallel on the first plane 58*x* of the mounting plate 58. The second board 62 is located between the two third boards 63 below the center of the first space S1 in the left-right direction, and is provided so as to be plane-parallel on the first plane 58*x* of the mounting plate 58. The fourth board 64 is located on the upper right side in the second space S2 and is provided so as to be plane-parallel on the second plane 58*y* of the mounting plate 58. The fifth board 65 is located on the upper left side in the second space S2 and is provided so as to be plane-parallel on the second plane 58*y* of the mounting plate 58.

Each of the first boards 61 is provided with a noise filter 61*a*, which is an electric component and a heat-generating component. The second board 62 is provided with an intelligent power module (IPM) 62*a*, which is an electric component used for the outdoor fan 26 and is a heat-generating component. Each of the third boards 63 is provided with an intelligent power module (IPM) 63*a*, which is an electric component for the inverter of the compressor 21 and is a heat-generating component. Note that the noise filter 61*a*, the IPM 62*a*, and the IPM 63*a* are all housed in the first space S1, but are located forwardly away from the back surface 57 of the electric component casing 50*a*. As a result, even if the cooling of the back surface 57 of the first space S1 by the first cooling portion 34 causes condensation on the back surface 57, the condensation water is suppressed from reaching the noise filter 61*a*, the IPM 62*a*, and the IPM 63*a*. Note that the first board 61, the second board 62, and the third board 63 are all used as they were when the outdoor unit 2 was shipped from the factory, without any work such as setting by a local worker when constructing the outdoor unit 2.

The fourth board 64 is an auxiliary control board and is provided with various electric components 64*a*. The fifth board 65 is a main control board and is provided with various electric components 65*a*. The refrigeration cycle apparatus 1 according to one or more embodiments has optional functions that can be optionally selected or added according to a user's desire or the like. Examples of the optional functions include, but are not limited to, on-demand control. The optional functions can be set on the fourth board 64 and the fifth board 65 arranged in the second space S2 of the outdoor control unit 50. The settings for the optional functions in the outdoor control unit 50 are made by a local worker accessing the fourth board 64 and the fifth board 65 and performing manual operations thereon during the construction of the outdoor unit 2. Specifically, the fourth board 64 and the fifth board 65 are each provided with switches or the like for making settings. Access to the fifth board 65 having the electric components 65*a* and the fourth board 64 having the electric components 64*a* can be made by removing the upper front lid 51. Note that the upper front lid 51 covering the second space S2 from the front is provided with the inspection port 51*a* that is closed by the inspection lid 51*b*, as described above. Therefore, with respect to the fifth board 65, it is possible to perform work such as construction or maintenance through the inspection port 51*a* by simply removing the inspection lid 51*b* without removing the entire upper front lid 51.

Note that an electric wire 61*b* extends from the first board 61. An electric wire 62*b* extends from the second board 62. An electric wire 63*b* extends from the third board 63. An electric wire 64*b* extends from the fourth board 64. An electric wire 65*b* extends from the fifth board 65. Note that these electric wires 61*b*, 62*b*, 63*b*, 64*b*, and 65*b* are illustrated only in FIGS. 10 and 11. The electric wires 61*b*, 62*b*, 64*b*, and 65*b* are connected to the connection terminals of a terminal block 69 that is provided on the lower right side in the third space S3. The electric wire 63*b* passes through the opening 56*b* by passing through the communication portion 94 of the wire seal material 90 attached to the lower surface 56 below the first space S1, and is then connected to the compressor 21.

Here, the electric wire 64*b* extending from the fourth board 64 and the electric wire 65*b* extending from the fifth board 65 in the second space S2 are drawn into the third space S3 through the first opening 59*a*, which is provided in the vicinity of the center of the partition plate 59 so as to penetrate the partition plate 59 in the vertical direction, and are connected to the connection terminals of the terminal block 69. More specifically, the electric wire 64*b* and the electric wire 65*b* pass through the first opening 59*a* by passing through the communication portion 94 of the wire seal material 90 attached to the partition plate 59.

In addition, the electric wire 61*b* extending from the first board 61 and the electric wire 62*b* extending from the second board 62 in the first space S1 are drawn into the second space S2 through the second opening 58*a*, which is provided in the vicinity of the center of the mounting plate 58 so as to penetrate the mounting plate 58 in the front-rear direction, then drawn into the third space S3 through the first opening 59*a* in the partition plate 59, and connected to the connection terminals of the terminal block 69. More specifically, the electric wire 61*b* and the electric wire 62*b* pass through the second opening 58*a* by passing through the communication portion 94 of the wire seal material 90 attached to the mounting plate 58, and then pass through the first opening 59*a* by passing through the communication portion 94 of the wire seal material 90 attached to the partition plate 59.

Note that an electric wire 95 extending from each control equipment, each sensor, or the like to be connected other than the compressor 21 is connected to the connection terminals of the terminal block 69. An opening 56*a* for allowing passage of the electric wire 95 extending from equipment other than the compressor 21 is provided in the portion of the lower surface 56 of the electric component casing 50*a* which is located below the terminal block 69 in the third space S3. In one or more embodiments, the electric wire 63*b* that passes through the opening 56*b* of the lower surface 56 located below the first space S1 is already connected to the compressor 21 at the time of the factory shipment of the outdoor unit 2, but the electric wire 95 extending from other equipment and the connection terminals of the terminal block 69 are not connected at the time of the factory shipment of the outdoor unit 2, and are connected by a local worker during construction. Specifically, the worker removes the lower front lid 52 to release the third space S3, connects the electric wire 95 extending from each equipment other than the compressor 21 to the connection terminals of the terminal block 69 through the opening 56*a* in the lower surface 56, and seals the third space S3 with the lower front lid 52.

(5) Cooling by First Cooling Portion 34

The first space S1 of the outdoor control unit 50 is cooled by the first cooling portion 34 of the first cooling circuit 31. Specifically, in the vicinity of the upper end on the back side of the electric component casing 50*a*, the first cooling portion 34 of the first cooling circuit 31 is provided in thermal contact with the electric component from the back side with the plurality of first heat transfer members 34*a* interposed therebetween. Each of the first heat transfer members 34*a* has a flat surface that extends parallel to the back surface 57 of the electric component casing 50*a*, and is used with the flat surface of the first heat transfer member 34*a* in surface contact with the back surface 57. The first cooling portion 34 extends from the left end to the right end on the back side of the electric component casing 50*a*, then folds back the U-shaped portion, and extends to the left end, so that the outgoing and returning sections are vertically aligned.

As described above, in the first space S1 of the outdoor control unit 50, the upper space on the back side is cooled by the first cooling portion 34 of the first cooling circuit 31, thereby allowing natural convection such as indicated by the dotted line in FIG. 12 to occur in the first space S1, and allowing an increase in the cooling efficiency of the first space S1. Specifically, the cold air generated on the upper back side of the first space S1 descends on the back side, and then is warmed by cooling the IPM 62*a* and the IPM 63*a*, which are heat-generating components, rises as an updraft on the front side, also cools the noise filter 61*a*, which is a heat-generating component, and circulates. In one or more embodiments, since the IPM 62*a* and the IPM 63*a* have a higher degree of heat generation than the noise filter 61*a*, the IPM 62*a* and the IPM 63*a* can be cooled.

The plurality of first heat transfer members 34*a* are fixed in a state of being pressed toward the back surface 57 of the electric component casing 50*a* by using a fixing portion 70 and a spacer 72 to be described below.

The fixing portion 70 has a back-side fixation member 71, a left-side fixation member 73, a right-side fixation member 74, a left-side fixation-receiving member 75, a right-side fixation-receiving member 76, a screw 77, and a screw 78.

The back-side fixation member 71 is a bar-shaped member that extends along the left-right direction which is the longitudinal direction of the first cooling portion 34 in the vicinity of the upper end of the back surface 57 of the electric component casing 50*a*. The right end of the back-side fixation member 71 is located further rightward than the right side surface 54 of the electric component casing 50*a*. The left end of the back-side fixation member 71 is located further leftward than the left side surface 53 of the electric component casing 50*a*.

The left-side fixation member 73 is a bar-shaped member that extends along the front-rear direction in the vicinity of the upper end of the left side surface 53 of the electric component casing 50*a*. The rear end of the left-side fixation member 73 is coupled to the left end of the back-side fixation member 71. The left-side fixation-receiving member 75 is fixed to the outside of the left side surface 53 of the electric component casing 50*a* by brazing, screws, or the like. The left-side fixation-receiving member 75 has a fixation-receiving portion forward of the center of the electric component casing 50*a* in the front-rear direction, the fixation-receiving portion protruding further leftward from the left side surface 53. The screw 77 fastens the front end of the left-side fixation member 73 to the fixation-receiving portion of the left-side fixation-receiving member 75. Specifically, with the fixation-receiving portion of the left-side fixation-receiving member 75 disposed in contact with the front end of the left-side fixation member 73 from the front, the screw 77 is screwed from the front of the fixation-receiving portion of the left-side fixation-receiving member 75 toward the rear to fasten both. The left-side fixation member 73 is pulled forward by being coupled to the left-side fixation-receiving member 75 with the screw 77. As a result, the left end of the back-side fixation member 71 coupled to the left-side fixation member 73 is urged toward the front.

The right-side fixation member 74 is a bar-shaped member that extends along the front-rear direction in the vicinity of the upper end of the right side surface 54 of the electric component casing 50*a*. The rear end of the right-side fixation member 74 is coupled to the right end of the back-side fixation member 71. The right-side fixation-receiving member 76 is fixed to the outside of the right side surface 54 of the electric component casing 50*a* by brazing, screws, or the like. The right-side fixation-receiving member 76 has a fixation-receiving portion forward of the center of the electric component casing 50*a* in the front-rear direction, the fixation-receiving portion protruding further rightward from the right side surface 54. The screw 78 fastens the front end of the right-side fixation member 74 to the fixation-receiving portion of the right-side fixation-receiving member 76. Specifically, with the fixation-receiving portion of the right-side fixation-receiving member 76 disposed in contact with the front end of the right-side fixation member 74 from the front, the screw 78 is screwed from the front of the fixation-receiving portion of the right-side fixation-receiving member 76 toward the rear to fasten both. The right-side fixation member 74 is pulled forward by being coupled to the right-side fixation-receiving member 76 with the screw 78. As a result, the right end of the back-side fixation member 71 coupled to the right-side fixation member 74 is urged toward the front.

Note that the spacer 72 is provided so as to be in contact with the back side of the plurality of first heat transfer members 34*a*, and is a bar-shaped member that extends along the left-right direction which is the longitudinal direction of the first cooling portion 34. The back-side fixation member 71 is in contact with the back side of the spacer 72. The left end of the spacer 72 is located further rightward than the left end of the back-side fixation member 71, and the right end of the spacer 72 is located further leftward than the right end of the back-side fixation member 71. The portion of the first cooling portion 34 extending leftward from the lower end of the U-shaped portion is located below the spacer 72, and the portion of the first cooling portion 34 extending leftward from the upper end of the U-shaped portion is located above the spacer 72. The U-shaped portion of the first cooling portion 34 is located further rightward than the right end of the spacer 72. This prevents the back-side fixation member 71 from crushing the U-shaped portion of the first cooling portion 34, even when the back-side fixation member 71 is urged toward the front.

Note that the first cooling portion 34 of the first cooling circuit 31 is located between the back surface 57 of the electric component casing 50*a* and the back-side fixation member 71 as viewed from the top. As a result, the back surface 57, the first cooling portion 34, and the back-side fixation member 71 are arranged in this order from the front.

With the above arrangement configuration, the left-side fixation member 73 and the right-side fixation member 74 are urged toward the front, so that the back-side fixation member 71 can press the plurality of first heat transfer members 34*a* against the back surface 57 of the electric component casing 50*a* with the spacer 72 interposed therebetween. The plurality of first heat transfer members 34*a* to which the first cooling portion 34 of the first cooling circuit 31 is fixed maintain good contact with the back surface 57 of the electric component casing 50*a*. As a result, the first cooling portion 34 of the first cooling circuit 31 can be brought into thermal contact with the back surface 57 of the electric component casing 50*a*.

(6) Cooling by Second Cooling Portion 38

In the upper vicinity of the portion of the mounting plate 58 of the outdoor control unit 50 which faces the third space S3, the second cooling portion 38 of the second cooling circuit 35 is provided in thermal contact with the electric component with the plurality of second heat transfer members 38*a* interposed therebetween. Each of the second heat transfer members 38*a* has a flat surface that extends parallel to the mounting plate 58, and is used with the flat surface of the second heat transfer member 38*a* in surface contact with the mounting plate 58.

The first connection pipe 39*a* and the second connection pipe 39*b* connected to the ends of the second cooling portion 38 pass vertically through the opening of the movable surface 56*m* that is provided at the portion of the lower surface 56 of the electric component casing 50*a* which is located at the lower left of the third space S3. As a result, the second cooling circuit 35 is drawn into the third space S3, and the second cooling portion 38 is located in the third space S3. In the third space S3, the second cooling portion 38 extends from the region where the second cooling portion 38 is connected to the end of the first connection pipe 39*a* to the right end, then folds back the U-shaped portion, and extends back to the left side until reaching the region where the second cooling portion 38 is connected to the end of the second connection pipe 39*b*. The connection region between the second connection pipe 39*b* and the second cooling portion 38 is lined up above the connection region between the first connection pipe 39*a* and the second cooling portion 38.

As described above, the upper vicinity of the portion of the mounting plate 58 of the outdoor control unit 50 which faces the third space S3 is cooled by the second cooling portion 38 of the second cooling circuit 35, whereby the IPM 62*a* and the IPM 63*a*, which are heat-generating components provided in the first space S1 that faces the first plane 58*x* of the mounting plate 58 facing the reverse side from the third space S3 side, can be cooled.

Note that each of the second heat transfer members 38*a* is fixed to the mounting plate 58 from the front side by a screw 38*b* that extends in the front-rear direction.

(7) Details of Second Cooling Portion 38

The second cooling circuit 35 has the first connection pipe 39*a* that extends from one end of the second cooling portion 38 on the lower side and the second connection pipe 39*b* that extends from the other end of the second cooling portion 38 on the upper side.

The first connection pipe 39*a* has pipe portions of a first curved portion 81*a*, a first straight portion 81*b*, a second curved portion 81*c*, a second straight portion 82, a third curved portion 83*a*, a third straight portion 83*b*, a fourth curved portion 83*c*, a fifth curved portion 84*a*, a fourth straight portion 84*b*, and a sixth curved portion 84*c*. The first curved portion 81*a*, the first straight portion 81*b*, the second curved portion 81*c*, the second straight portion 82, the third curved portion 83*a*, the third straight portion 83*b*, the fourth curved portion 83*c*, the fifth curved portion 84*a*, the fourth straight portion 84*b*, and the sixth curved portion 84*c* are connected to each other in this order from one end of the second cooling portion 38 on the lower side. Note that the first straight portion 81*b*, the third straight portion 83*b*, and the fourth straight portion 84*b* all extend in the vertical direction. In one or more embodiments, the fourth straight portion 84*b* is longer than the first straight portion 81*b* and longer than the third straight portion 83*b*. The second straight portion 82 extends in the left-right direction. The first curved portion 81*a*, the second curved portion 81*c*, the third curved portion 83*a*, the fourth curved portion 83*c*, the fifth curved portion 84*a*, and the sixth curved portion 84*c* all have a 90-degree curved shape.

The second connection pipe 39*b* has pipe portions of a seventh curved portion 85*a*, a fifth straight portion 85*b*, an eighth curved portion 85*c*, a sixth straight portion 86, a ninth curved portion 87*a*, a seventh straight portion 87*b*, a tenth curved portion 87*c*, an eighth straight portion 88, an eleventh curved portion 89*a*, a ninth straight portion 89*b*, and a twelfth curved portion 89*c*. The seventh curved portion 85*a*, the fifth straight portion 85*b*, the eighth curved portion 85*c*, the sixth straight portion 86, the ninth curved portion 87*a*, the seventh straight portion 87*b*, the tenth curved portion 87*c*, the eighth straight portion 88, the eleventh curved portion 89*a*, the ninth straight portion 89*b*, and the twelfth curved portion 89*c* are connected to each other in this order from the other end of the second cooling portion 38 on the upper side. Note that the fifth straight portion 85*b*, the seventh straight portion 87*b*, and the ninth straight portion 89*b* all extend in the vertical direction. In one or more embodiments, the ninth straight portion 89*b* is longer than the fifth straight portion 85*b* and longer than the seventh straight portion 87*b*. The sixth straight portion 86 and the eighth straight portion 88 extend in the left-right direction. The seventh curved portion 85*a*, the eighth curved portion 85*c*, the ninth curved portion 87*a*, the tenth curved portion 87*c*, the eleventh curved portion 89*a*, and the twelfth curved portion 89*c* all have a 90-degree curved shape.

With the above configuration, the first connection pipe 39*a* bends downward at the first curved portion 81*a* from the lower end of the second cooling portion 38 and extends downward at the first straight portion 81*b*, thereby penetrating the movable surface 56*m* in the vertical direction and extending outward and downward from the electric component casing 50*a*. Then the first connection pipe 39*a* bends leftward at the second curved portion 81*c*, extends leftward at the second straight portion 82, and then bends upward at the third curved portion 83*a*. Further, the first connection pipe 39*a* extends upward at the third straight portion 83*b*, then bends leftward at the fourth curved portion 83*c*, bends downward at the fifth curved portion 84*a*, then extends downward at the fourth straight portion 84*b*, and bends rightward at the sixth curved portion 84*c*.

In addition, the second connection pipe 39*b* bends downward at the seventh curved portion 85*a* from the upper end of the second cooling portion 38 and extends downward at the fifth straight portion 85*b*, thereby penetrating the movable surface 56*m* in the vertical direction and extending outward and downward from the electric component casing 50*a*. Then the second connection pipe 39*b* bends leftward at the eighth curved portion 85*c*, extends leftward at the sixth straight portion 86, and then bends upward at the ninth curved portion 87*a*. Further, the second connection pipe 39*b* extends upward at the seventh straight portion 87*b* and then bends leftward at the tenth curved portion 87*c*. Furthermore, the second connection pipe 39*b* extends leftward at the eighth straight portion 88, then bends downward at the eleventh curved portion 89*a*, extends downward at the ninth straight portion 89*b*, and then bends rightward at the twelfth curved portion 89*c*.

Here, the first connection pipe 39*a* and the second connection pipe 39*b* extend along each other, and are sufficiently long in the portion extending substantially parallel to the direction that is the axis of rotation of the second cooling circuit 35.

(8) Maintenance and the Like of Outdoor Control Unit 50

As described above, in the outdoor control unit 50, various types of maintenance are performed on the first board 61, second board 62, and third board 63 attached to the first plane 58*x* of the mounting plate 58, and the fourth board 64 and fifth board 65 attached to the second plane 58*y* of the mounting plate 58 after the construction of the outdoor unit 2 of the refrigeration cycle apparatus 1.

Figure 6:
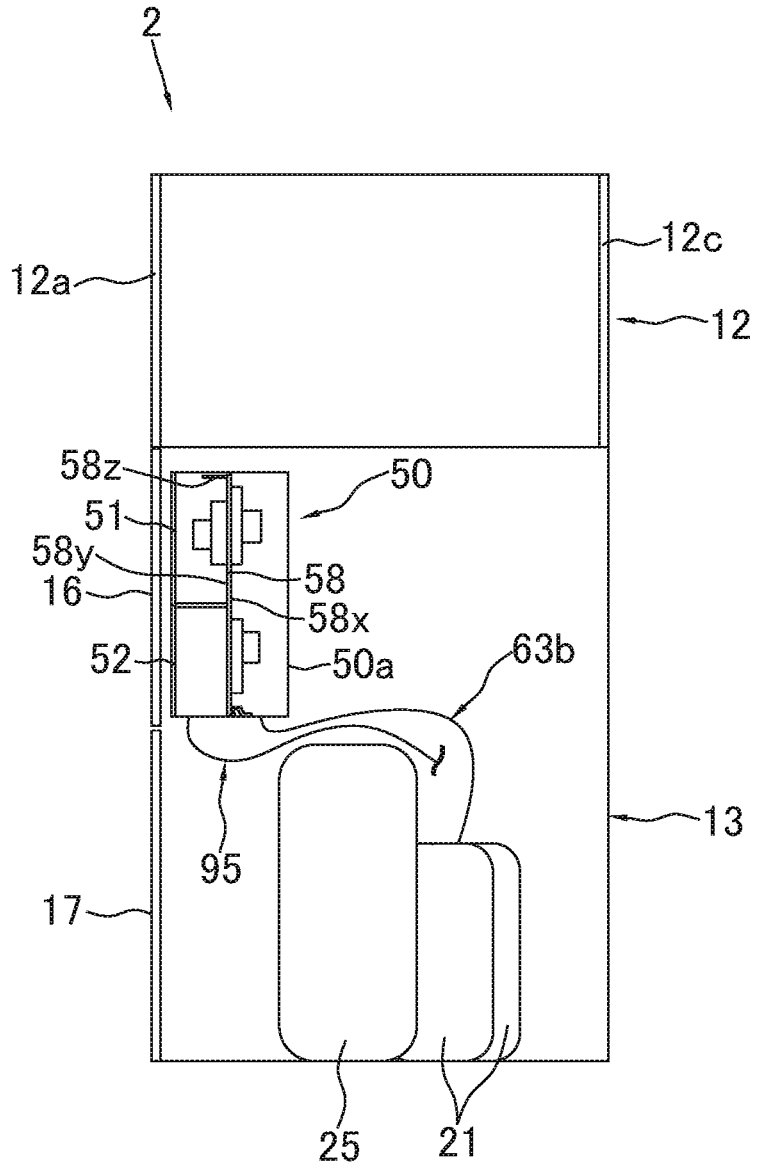
FIG. 6 is a schematic sectional side view of the outdoor unit.
Figure 7:
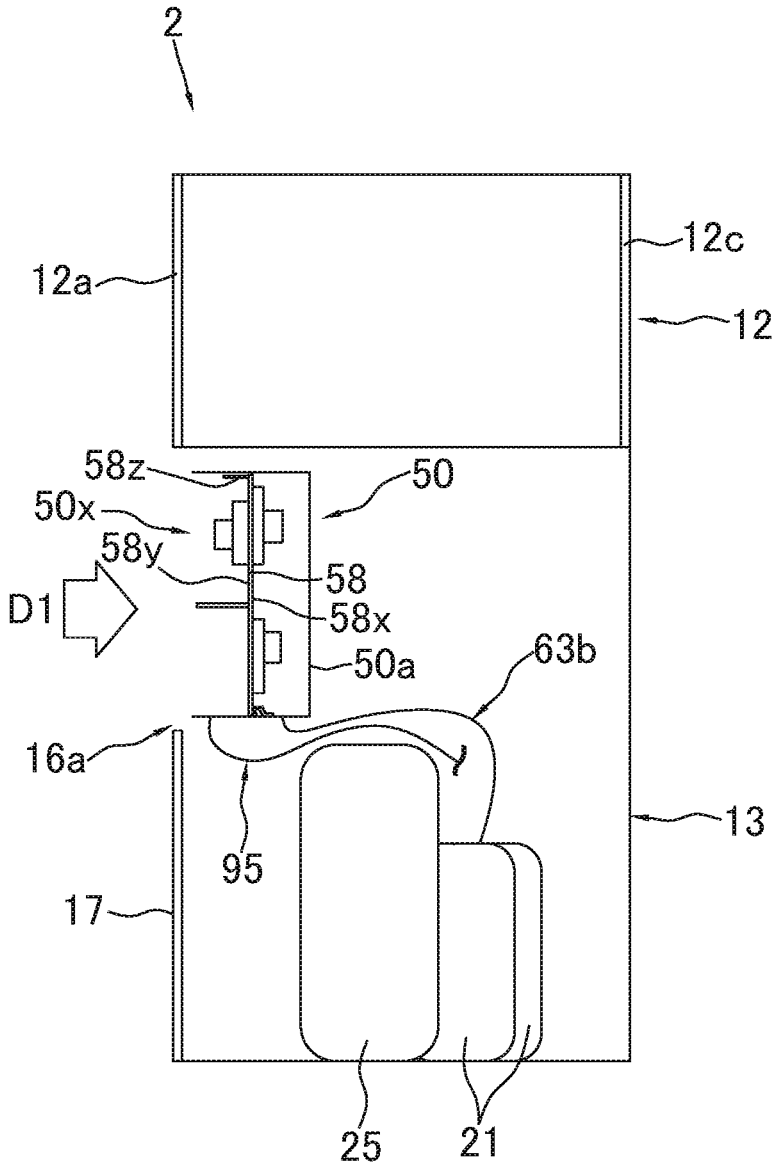
FIG. 7 is a schematic sectional side view illustrating the outdoor control unit with an upper front panel, an upper front lid, and a lower front lid removed (i.e., first state).

In the outdoor control unit 50, the maintenance of the fourth board 64 and fifth board 65 attached to the second plane 58*y* of the mounting plate 58 is performed by removing the upper front panel 16 of the outdoor unit casing 11, then removing the upper front lid 51 and lower front lid 52 of the electric component casing 50*a* to release the electric component maintenance opening 50*x*, and accessing the electric component maintenance opening 50*x* from the direction indicated by arrow D1 in FIG. 7, as illustrated in the schematic sectional side views of FIGS. 6 and 7. In this way, while the outdoor control unit 50 extends vertically (i.e., first state), maintenance, such as replacement and setting, can be performed on the fourth board 64 and the fifth board 65 after construction. Note that, even during construction, various settings for the fourth board 64 and the fifth board 65 are performed by releasing the electric component maintenance opening 50*x* and making the electric component maintenance opening 50*x* accessible from the direction indicated by arrow D1 in FIG. 7.

Next, in the outdoor control unit 50, for the maintenance of the first board 61, second board 62, and third board 63 attached to the first plane 58*x* of the mounting plate 58, the second cooling circuit 35 is rotated out to the front and then the mounting plate 58 is turned down forward by 90 degrees with respect to the electric component casing 50*a*, as illustrated in FIGS. 8, 14, 16, and 17. This allows the first plane 58*x* of the mounting plate 58 to face vertically upward, thereby allowing the worker to work while looking down the first board 61, the second board 62, and the third board 63 from above. In addition, since the first plane 58*x* of the mounting plate 58 is horizontally spread, the mounting plate 58 can be used as a work table while components necessary for work are placed on the first plane 58*x* of the mounting plate 58, thereby improving the efficiency of work. In this way, while the outdoor control unit 50 is laid horizontally (i.e., second state), maintenance, such as replacement and setting, can be performed on the first board 61, the second board 62, and the third board 63 after construction. In addition, since the mounting plate 58 is simply rotated forward with respect to the electric component casing 50*a*, work can be performed without removing the electric wire that connects the outdoor control unit 50 to the control equipment. Furthermore, when turned down forward with respect to the electric component casing 50*a*, the mounting plate 58 overlaps the opening 16*a* of the outdoor unit casing 11 in plan view, but the mounting plate 58 is located inside the opening 16*a* of the outdoor unit casing 11 in front view and does not contact the edge of the opening 16*a*. As a result, it is possible to prevent the weight of the mounting plate 58, which is heavy with multiple electric components and the like, from being imposed on the edge of the opening 16*a* of the outdoor unit casing 11.

Figure 14:
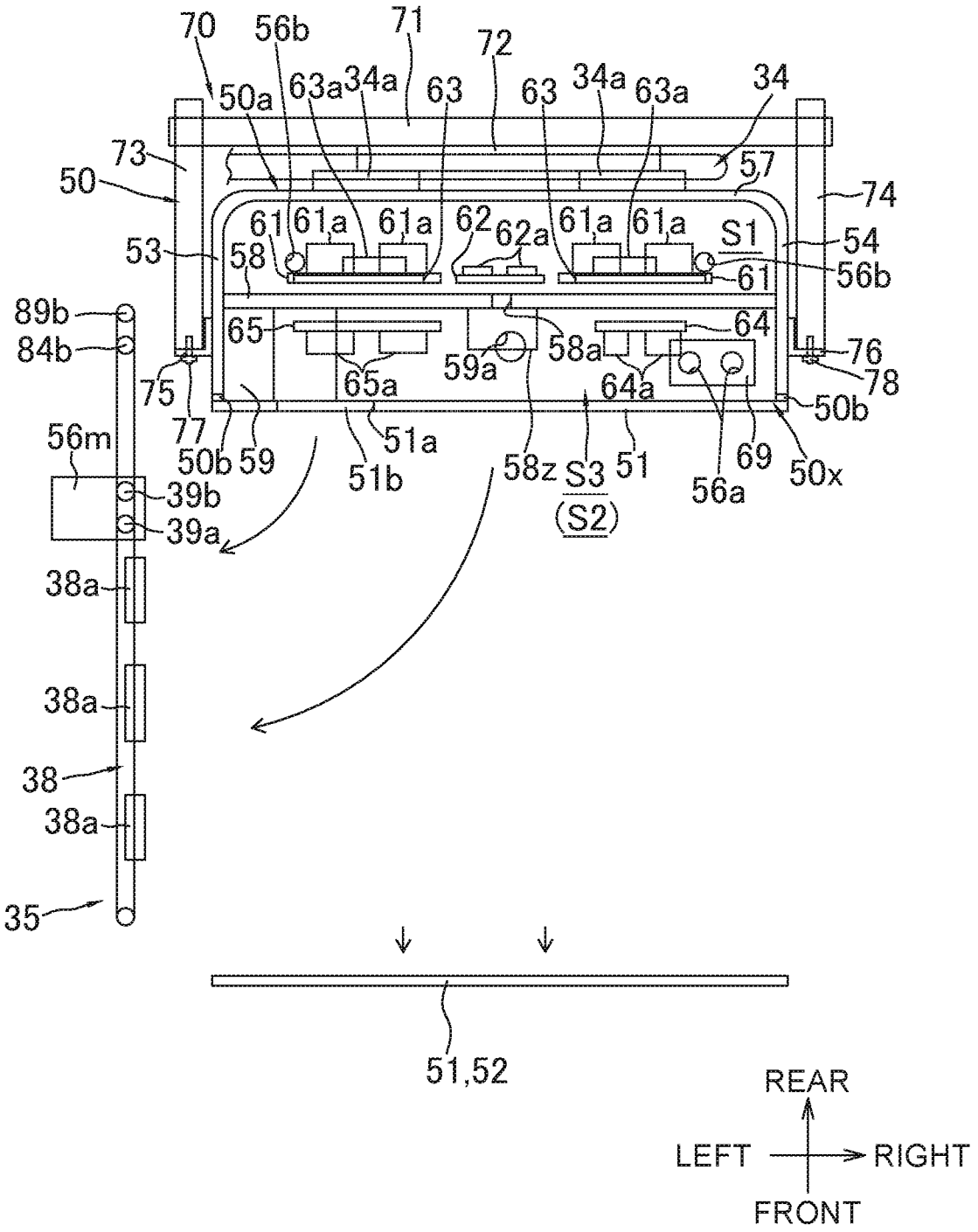
FIG. 14 is a schematic configuration diagram of the periphery of the outdoor control unit in plan view with the second cooling portion rotated out to the front.

Specifically, as illustrated in FIG. 14, the second cooling circuit 35 can be pivotally moved forward with the vertically-extending portion on the left side as a substantial rotation axis. Here, when pivotally moving the second cooling circuit 35, the upper front panel 16 of the outdoor unit casing 11 is removed, and the upper front lid 51 and lower front lid 52 of the outdoor control unit 50 are removed to open the electric component maintenance opening 50*x*. The worker then removes the second heat transfer members 38*a* from the mounting plate 58 by removing the screws 38*b*. In this state, the worker rotates the second cooling circuit 35 by 90 degrees by twisting the fourth straight portion 84*b* of the first connection pipe 39*a* and the ninth straight portion 89*b* of the second connection pipe 39*b* as the axes of rotation, or by twisting the region between the fourth straight portion 84*b* and the ninth straight portion 89*b* as the axis of rotation. As a result, the second cooling portion 38 of the second cooling circuit 35 can be pivotally moved forward while keeping the movable surface 56*m* of the lower surface 56 of the electric component casing 50*a* integral with the first connection pipe 39*a* and the second connection pipe 39*b*.

Figure 16:
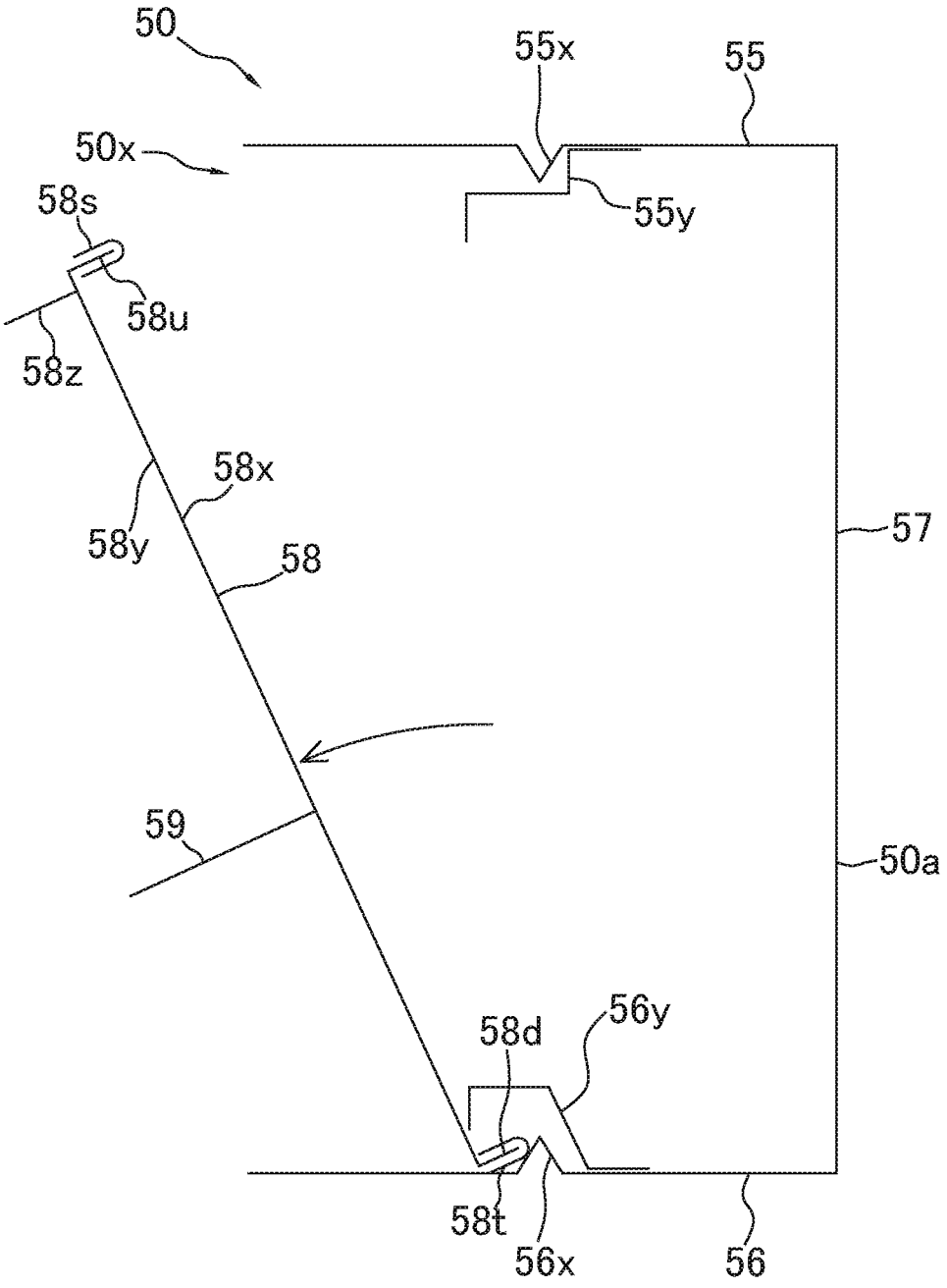
FIG. 16 is a simplified sectional side view of the outdoor control unit with the mounting plate, the electric components, and the like in the process of being rotated out to the front.
Figure 17:
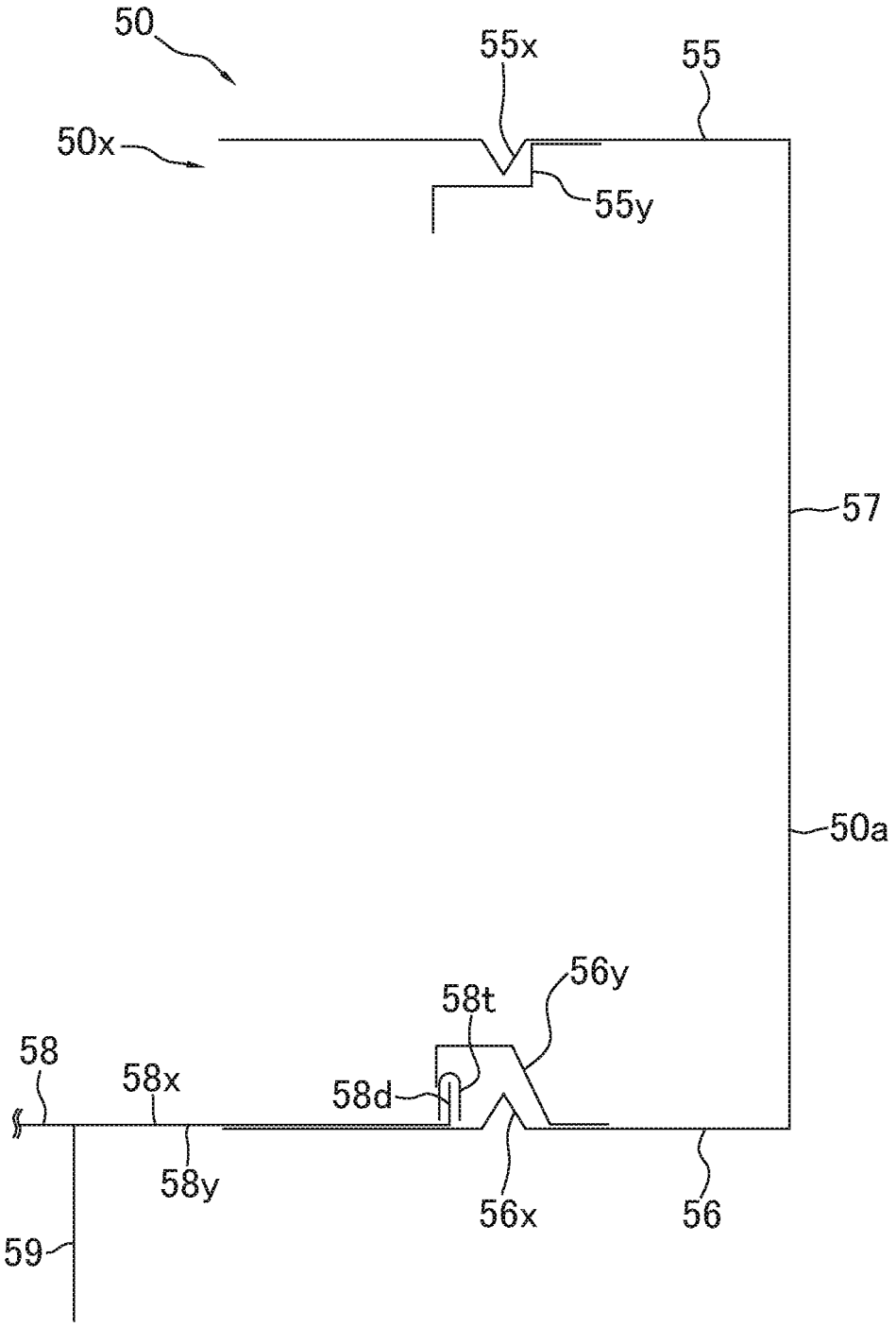
FIG. 17 is a simplified sectional side view of the outdoor control unit with the mounting plate, the electric components, and the like rotated out to the front (i.e., second state).

Thus, as shown in FIG. 16, the mounting plate 58 can be rotated out in such a manner that the mounting plate 58 falls forward, using the connection region between the lower end (i.e., bottom end) of the mounting plate 58 and the lower surface 56 of the electric component casing 50*a*, or the periphery thereof as a substantial rotation axis. Note that, as illustrated in FIG. 17, the mounting plate 58 rotated out to the front is horizontally supported by the electric component casing 50*a*. Specifically, the second plane 58*y* of the mounting plate 58 is supported such that the portion of the lower surface 56 of the electric component casing 50*a* forward of the protrusion 56*x* is in surface contact from below. Further, the leading end vicinity of the lower surface portion 58*d* of the mounting plate 58 is supported by the fixation member 56*y* fixed to the lower surface 56 of the electric component casing 50*a*, with the seal material 58*t* interposed therebetween. More specifically, the leading end vicinity of the lower surface portion 58*d* of the mounting plate 58 is urged forward by the weight of the mounting plate 58 and the boards attached to the mounting plate 58, but is supported toward the rear by the rear surface of the front end of the fixation member 56*y* of the electric component casing 50*a*.

(9) Features of Embodiments

In the outdoor unit 2 of the refrigeration cycle apparatus 1 according to one or more embodiments, the outdoor control unit 50 is provided with the plurality of boards on both the first plane 58*x* and the second plane 58*y* of the single mounting plate 58, so that a large number of electric components can be mounted. Thus, even in a case where the outdoor unit 2 has a large capacity and the number of elements to be controlled increases, such as a case where multiple compressors 21 are provided, the space for housing the electric components can be downsized. As a result, the size of the outdoor control unit 50 can be reduced.

Furthermore, even in this configuration with the electric components on both surfaces of the mounting plate 58, the outdoor control unit 50 according to one or more embodiments can switch between a vertically extended state (i.e., first state) and a horizontally laid state (i.e., second state) in the electric component casing 50*a* by rotating the mounting plate 58 with respect to the electric component casing 50*a*. Thus, even if the electric components are provided on both surfaces of the mounting plate 58, maintenance or the like of the electric components mounted on each surface can be easily performed. It is also possible to reduce a work space required for maintenance of the electric components.

Further, the mounting plate 58 can be rotated with respect to the electric component casing 50*a* by a simple configuration in which the lower surface portion 58*d* of the mounting plate 58 is simply hooked on the fixation member 56*y* of the electric component casing 50*a* with the seal material 58*t* interposed therebetween. This allows the cost to be kept low as compared with a complicated structure such as coupling the two with hinges or the like.

In addition, since the outdoor control unit 50 is cooled by using the first cooling portion 34 of the first cooling circuit 31 and the second cooling portion 38 of the second cooling circuit 35, it is possible to suppress the heat generated by the electric components and to enhance the reliability of the outdoor control unit 50.

(10) Other Embodiments (10-1) Other Embodiments A

In the above embodiments, the case has been described as an example where the mounting plate 58 rotates about the contact region between the lower end of the mounting plate 58 and the lower surface 56 of the electric component casing 50*a*, and the first plane 58*x* is in an orientation facing vertically upward.

Meanwhile, the mode in which the mounting plate 58 rotates with respect to the electric component casing 50*a* is not limited thereto, and for example, the mounting plate 58 may rotate about the contact region between the upper end of the mounting plate 58 and the top surface 55 of the electric component casing 50*a*. Alternatively, the mounting plate 58 may rotate with respect to the electric component casing 50*a* about the region between the upper end and lower end of the mounting plate 58. Further, the structure may be such that the mounting plate 58 is rotatable with respect to the electric component casing 50*a* with the left end or right end of the mounting plate 58 as a rotation axis.

Note that these specific structures for enabling the mounting plate 58 to rotate are not limited. For example, the mounting plate 58 and the electric component casing 50*a* may be coupled by a rotatable structure such as a hinge.

(10-2) Other Embodiments B

In the above embodiments, the case where the mounting plate 58 is rotated by 90 degrees with respect to the electric component casing 50*a* has been described as an example.

Meanwhile, the angle at which the mounting plate 58 rotates with respect to the electric component casing 50*a* is not limited, and may be any angle that facilitates maintenance work or the like of the electric components mounted on both surfaces of the mounting plate 58. For example, the mounting plate 58 may rotate 180 degrees with respect to the electric component casing 50*a*.

(10-3) Others

The structure for rotating the mounting member about the coupling portion is not limited, and may be, for example, a hinge structure for coupling the mounting member to the electric component casing, or a structure for rotating the mounting member about the coupling portion while the mounting member remains hooked onto the electric component casing. Alternatively, the mounting member may rotate about the region where the mounting member is coupled to the coupling portion.

Note that in the second state, the mounting member may be located at a position overlapping the heat source maintenance opening in top view.

(Supplement)

Although the disclosure has been described with respect to only a limited number of embodiments, those skilled in the art, having benefit of this disclosure, will appreciate that various other embodiments may be devised without departing from the scope of the present disclosure. Accordingly, the scope of the disclosure should be limited only by the attached claims.

REFERENCE SIGNS LIST

1: refrigeration cycle apparatus
2: outdoor unit (heat source unit)
4: indoor unit
5: gas-refrigerant communication pipe
6: liquid-refrigerant communication pipe
10: refrigerant circuit
11: outdoor unit casing (heat source casing)
16: upper front panel
16*a*: opening (heat source maintenance opening)
21: compressor
23: outdoor heat exchanger
26: outdoor fan
30: cooling circuit
31: first cooling circuit
34: first cooling portion
34*a*: first heat transfer member
35: second cooling circuit
38: second cooling portion
50: outdoor control unit (electric component unit)
50*a*: electric component casing
50*b*: lid seal material
50*x*: electric component maintenance opening (maintenance opening)
51: upper front lid
51*a*: inspection port
51*b*: inspection lid
52: lower front lid
53: left side surface
54: right side surface
55*y*: fixation member
56*y*: fixation member (coupling portion)
57: back surface
58: mounting plate (mounting member)
58*a*: second opening
58*d*: lower surface portion (coupling portion)
58*s*: seal material
58*t*: seal material
58*u*: upper surface portion
58*x*: first plane (first surface)
58*y*: second plane (second surface)
59: partition plate
59*a*: first opening
59*y*: second plane (second surface)
61: first board (first electric board)
61*a*: noise filter
62: second board (first electric board)
62*a*: IPM
63: third board (first electric board)
63*a*: IPM
64: fourth board (second electric board)
64*a*: electric component
65: fifth board (second electric board)
65*a*: electric component
69: terminal block
90: wire seal material
S1: first space
S2: second space
S3: third space

PATENT LITERATURE

Patent Literature 1: JP 2021-119322 A

What is claimed is:

1. A heat source unit for a refrigerant cycle apparatus, comprising:
- a heat source casing; and
- an electric component unit housed in the heat source casing and that comprises:
  - a first electric board;
  - a second electric board;
  - a mounting member having:
    - a first surface on which the first electric board is disposed, and
    - a second surface on which the second electric board is disposed; and
  - an electric component casing having a maintenance opening, wherein
- the mounting member is coupled to the electric component casing via a coupling portion,
- the electric component unit switches between a first state and a second state by rotation of the mounting member about the coupling portion,
- in the first state, the second electric board is accessible through the maintenance opening, and the first electric board, the second electric board, and the mounting member are all housed in the electric component casing, and
- in the second state, the first electric board is accessible through the maintenance opening.

2. The heat source unit according to claim 1, wherein the electric component unit switches from the first state to the second state in response to the mounting member rotating about the coupling portion toward the maintenance opening.

3. The heat source unit according to claim 1, wherein a bottom end of the mounting member is coupled to the electric component casing.

4. The heat source unit according to claim 1, wherein in the second state, the mounting member is hooked onto and supported by the electric component casing.

5. The heat source unit according to claim 1, wherein in switching from the first state to the second state, the mounting member rotates around the coupling portion by an angle equal to or more than 80 degrees and equal to or less than 100 degrees.

6. The heat source unit according to claim 1, wherein
- the heat source casing has a heat source maintenance opening, and
- the mounting member is not in contact with an edge of the heat source maintenance opening in the second state.

7. The heat source unit according to claim 1, further comprising
- a compressor disposed below a bottom end of the electric component unit.

* * * * *